US008436877B2

(12) United States Patent
Kanno et al.

(10) Patent No.: US 8,436,877 B2
(45) Date of Patent: May 7, 2013

(54) CARD PRINTER AND CARD PRINTING/STACKING DEVICE

(75) Inventors: Noriyuki Kanno, Tokyo (JP); Kenichi Ito, Tokyo (JP); Kosuke Masuda, Tokyo (JP); Koji Kuroiwa, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 247 days.

(21) Appl. No.: 12/935,323

(22) PCT Filed: Mar. 31, 2009

(86) PCT No.: PCT/JP2009/001516

§ 371 (c)(1),
(2), (4) Date: Nov. 8, 2010

(87) PCT Pub. No.: WO2009/122732

PCT Pub. Date: Oct. 8, 2009

(65) Prior Publication Data

US 2011/0043587 A1 Feb. 24, 2011

(30) Foreign Application Priority Data

Mar. 31, 2008 (JP) ..... 2008-094020

(51) Int. Cl.
*B41J 2/00* (2006.01)
*G07B 15/02* (2011.01)

(52) U.S. Cl.
USPC ..... 347/110; 235/384

(58) Field of Classification Search ..... None
See application file for complete search history.

(56) References Cited

U.S. PATENT DOCUMENTS

| | | | | |
|---|---|---|---|---|
| 5,854,477 | A * | 12/1998 | Kawaji et al. | 235/384 |
| 6,048,269 | A | 4/2000 | Burns et al. | |
| 8,197,334 | B2 * | 6/2012 | Chudd et al. | 463/25 |
| 2006/0175398 | A1 * | 8/2006 | Hilton et al. | 235/382 |

FOREIGN PATENT DOCUMENTS

| | | | |
|---|---|---|---|
| JP | 1-214494 | A | 8/1989 |
| JP | 9-326052 | A | 12/1997 |
| JP | 2796021 | | 9/1998 |
| JP | 2004-362506 | A | 12/2004 |

* cited by examiner

*Primary Examiner* — Stephen Meier
*Assistant Examiner* — Tracey McMillion
(74) *Attorney, Agent, or Firm* — Bachman & LaPointe, P.C.

(57) ABSTRACT

Based on information recorded on and read out from a card, a card printer erasably writes information on the card or erases information recorded on the card. The card printer comprises transport means T for transporting card 70 along a passageway 5 having an inlet 4, reading means R provided in the vicinity of passageway 5 for reading out information recorded on a surface of card 70 transported along passageway 5, printing means P for recording information on and erasing information from the surface of card 70, and control means IC electrically connected to transport means T, reading means R and printing means P for determining whether to record information on or to erase information from surface of card 70 and for controlling operation of transport means T and printing means P depending on information forwarded from reading means R.

13 Claims, 37 Drawing Sheets

CARD PRINTER AND CARD PRINTING/STACKING DEVICE

TECHNICAL FIELD

This invention relates to a card printer and a card printing/stacking device capable of rewritably printing information on a card.

BACKGROUND OF THE INVENTION

A thermal reader/writer utilizes the interaction of mixed leuco dye and developer for repetitive writing and erasing. A reversible developer is used to achieve a rewritable property for development and disappearance in color under control of heated temperature and cooling time. By way of example, when a thermofusible ink containing a mixture of leuco dye and developer is heated over their melting point (for example at a temperature of about 170 degrees centigrade), dye and developer become soluble in one another in a printed layer, and when the ink is rapidly cooled in the soluble condition, dye and developer undergo crystallization under their mixed condition to maintain the coloring state. On the contrary, when the ink over the melting point is gradually cooled, dye and developer individually come to crystallization into an achromatized state without retaining the coloring state. However, even when the ink is heated during a given time at a temperature (around 120 to 140 degrees centigrade) less than the melting point, dye and developer may be separately crystallized into an achromatized state. In this way, an operator can select writing or erasing of thermal reader/writer by controlling the crystallizing process in the mixture of dye and developer. A thermal head is used for writing, and there are many methods for erasing.

Patent Document 1 below listed discloses a printing device which comprises storing means for accommodating a stack of media in a predetermined insertion direction for a printer, conveyor means for transporting the media to the printer, discrimination means for discriminating the back, forth, right or left direction of the inserted media relative to the printer, and print control means for controlling the printer to print on the media information depending on the discriminated result of the discrimination means.

Patent Document 2 teaches a coinless slot machine system provided with a printer for issuing tickets for a slot machine. Specifically, this coinless slot machine system can issue coupons to omit paying out of coins in order to drastically reduce safekeeping money for casino operation as is widely prevalent. However, utilization of coupons made of paper requires issuance of new tickets each time gaming machines for play are exchanged or on a liquidation basis, and therefore, it demands a vast number of tickets and this poses an impediment of cost-cutting.

[Patent Document 1] Japanese Patent No. 2,796,021

[Patent Document 2] U.S. Pat. No. 6,048,269

PROBLEM TO BE SOLVED BY THE INVENTION

On the other hand, a similar disadvantage arises in the Japanese pinball gaming market, and therefore, Patent Document 1 advances a device for reissuing record media or Patent Document 2 offers a record medium. However, change of prior art record media requires structural modifications to the issuing device and drastic alteration in design of gaming machines that incorporate such a issuing device and also to save a space for accommodating the issuing device while downsizing the entire unit has also been demanded.

An object of the present invention is to provide a card printer capable of newly and erasably writing information on a card or erasing information from a card based on information recorded on and read out from the card. Another object of the present invention is to provide a card printer capable of newly and erasably writing information on a card or erasing information from a card based on information recorded on and photo-electrically or magneto-electrically read out from the card. Still another object of the present invention is to provide a card printer capable of newly and erasably writing information on a card or erasing information from a card based on instruction signals from an external controller. A yet another object of the present invention is to provide a card printer capable of erasably writing predetermined information on a card or erasing predetermined information from a card. A further object of the present invention is to provide a card printing/stacking device that incorporates a stacker provided in the above card printer for storing cards in the stacker. A still further object of the present invention is to provide a card printing/stacking device capable of storing into a stacker cards lacking in the predetermined information. A yet further object of the present invention is to provide a card printing/stacking device capable of selectively printing information on a card or erasing information printed on a card and then storing the card in a stacker provided. An additional object of the present invention is to provide a card printer and a card printing/storing device capable of positively reusing cards with minimum modification to an associated prior art gaming machine or management system in the downsized design of the device.

SUMMARY OF THE INVENTION

The card printer according to the present invention, comprises: transport means (T) for transporting a card (70) along a passageway (5) having an inlet (4) formed at one end thereof for the card printer, reading means (R) provided in the vicinity of passageway (5) for reading out information recorded on a surface of card (70) transported along passageway (5), printing means (P) for recording information on and erasing information from the surface of card (70), and control means (IC) electrically connected to transport means (T), reading means (R) and printing means (P) for determining whether to record information on or to erase information from the surface of card (70) and for controlling operation of transport means (T) and printing means (P) depending on information forwarded from reading means (R). While transport means (T) transports card (70) inserted from inlet (4) along passageway (5), reading means (R) reads out information recorded on card (70) and forwards the information to control means (IC) that then rewritably prints information on card (70) or erases information recorded on card (70) in accordance with the information read out. A word "card" herein means a piece or ticket such as coupon made of paper, plastics, a laminate or combination of paper and plastic sheets.

EFFECT OF INVENTION

The card printer and card printing/stacker device according to the present invention may provide reflyable cards for tickets, cards, boarding passes or coupons used in game halls, transportation, casino, markets or department stores to reduce discarded amounts of nonreusable paper or plastics for resource saving.

EXPLANATION OF SYMBOLS (1) . . . a card printer, (4) . . . an inlet, (5) . . . a passageway, (7) . . . a stacker, (8) . . . an inlet sensor, (9) . . . an anterior sensor, (10) . . . an intermediate sensor, (11) . . . a retention motor, (13) . . . a first bell crank, (14) . . . a second bell crank, (15) . . . a guide, (16*a*) . . . a first holder, (16*b*) . . . a second holder, (17) . . . a first lever, (18) . . . a second lever, (19) . . . a rotary guide, (20) . . . a stack roller, (21) . . . a deflector, (22) . . . a stack motor, (23) . . . a posterior sensor, (24, 27*a*) . . . inlet rollers, (25,27*b*) . . . intermediate rollers, (26,27*c*) . . . posterior rollers, (30) . . . a feed motor, (45) . . . a head driver, (46) . . . a printer head, (47) . . . an eraser head, (48,49) . . . image sensors, (50) . . . a magnetic head, (51) . . . a storage, (52) . . . a collection device, (70) . . . a card, (C) . . . a conveyor, (D) . . . drive means, (F) . . . a power transmitter, (G) . . . a guide device, (H) . . . retainer means, (IC) . . . control means, (L) . . . a linkage, (P) . . . printing means, (R) . . . a reader, (RD) . . . a rotary guide device, (SR) . . . a stack roller device, (T) . . . transport means,

BEST MODE FOR CARRYING OUT THE INVENTION

Embodiments of the card printer and card printing/stacking device according to the present invention will be described hereinafter with reference to FIGS. 1 to 44 of the drawings.

Figure 1:
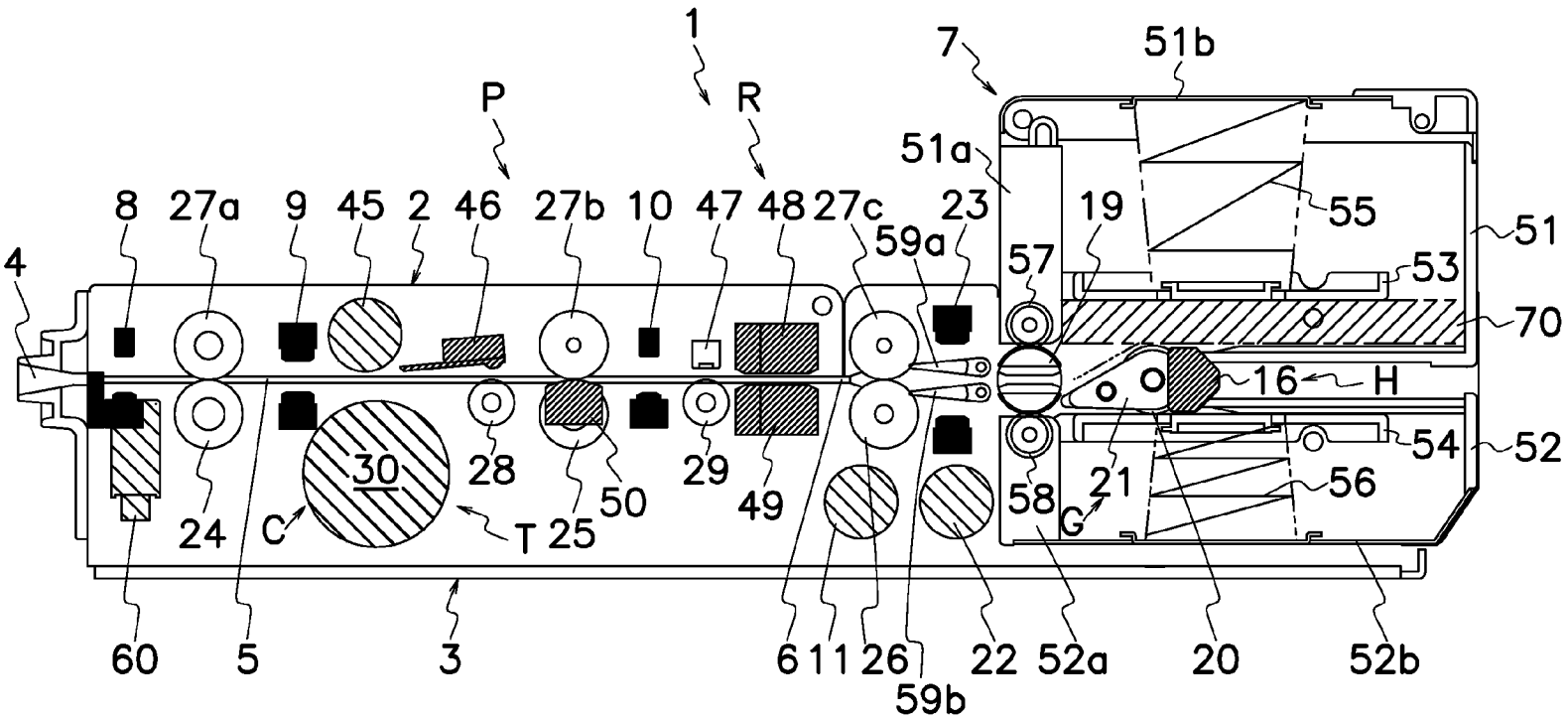
[FIG. 1] A sectional view of the card printing/stacking device according to the present invention.
Figure 2:
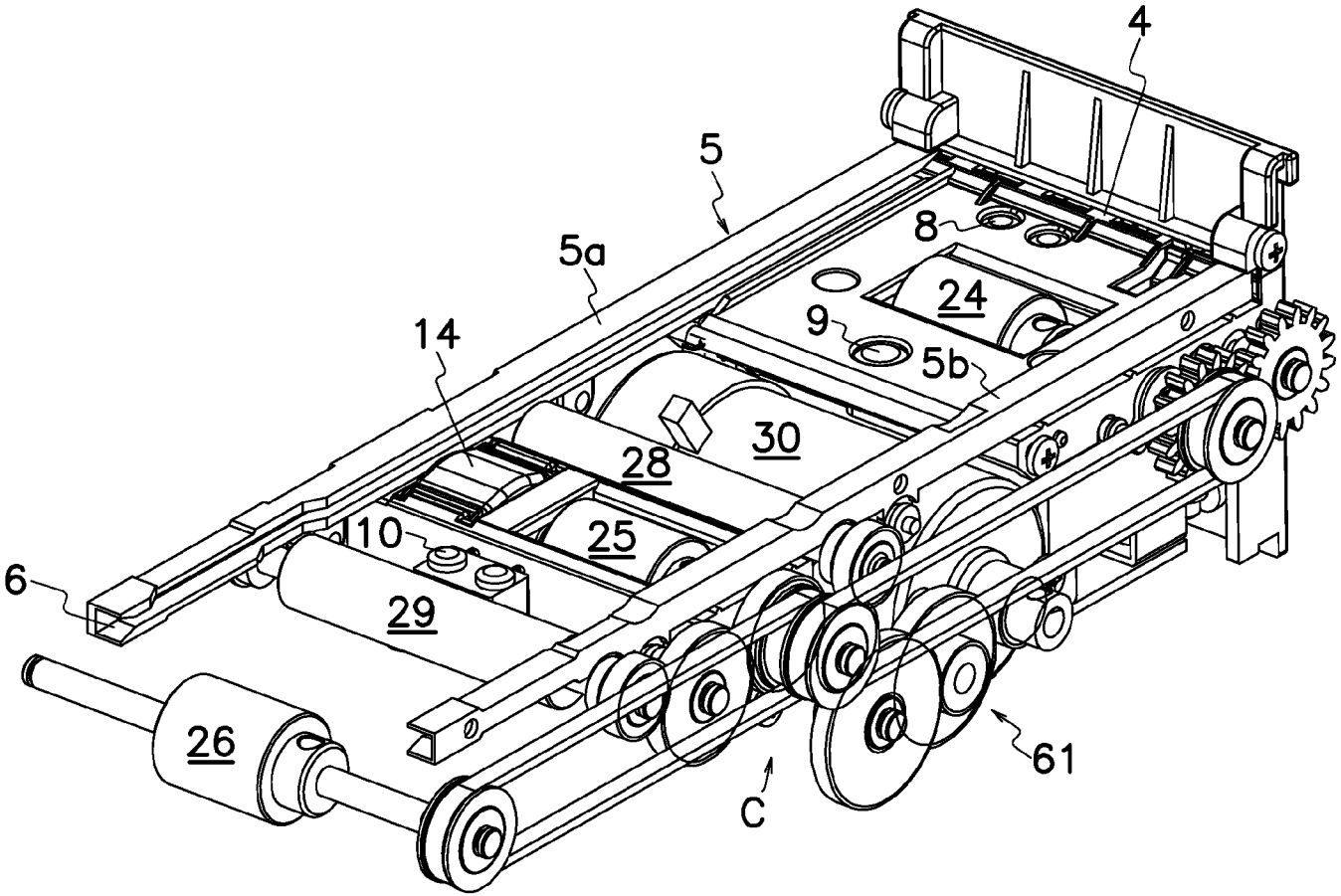
[FIG. 2] A perspective view of transport means in the card printer according to the present invention.

As shown in FIG. 1, the card printing/stacking device according to the present invention comprises a card printer 1 and a stacker 7 removably attached to card printer 1. Card printer 1 comprises transport means T for transporting a card 70 along a passageway 5 having an inlet 4 formed at one end thereof, reading means R provided in the vicinity of passageway 5 for reading out information recorded on a surface of card 70 transported along passageway 5, printing means P for recording information on and erasing information from the surface of card 70, and a controller, control means or control device IC (FIG. 44) electrically connected to transport means T, reading means R and printing means P for determining whether to record information on or to erase information from the surface of card 70 and for controlling operations of transport means T and printing means P depending on the information forwarded from reading means R.

Figure 43:
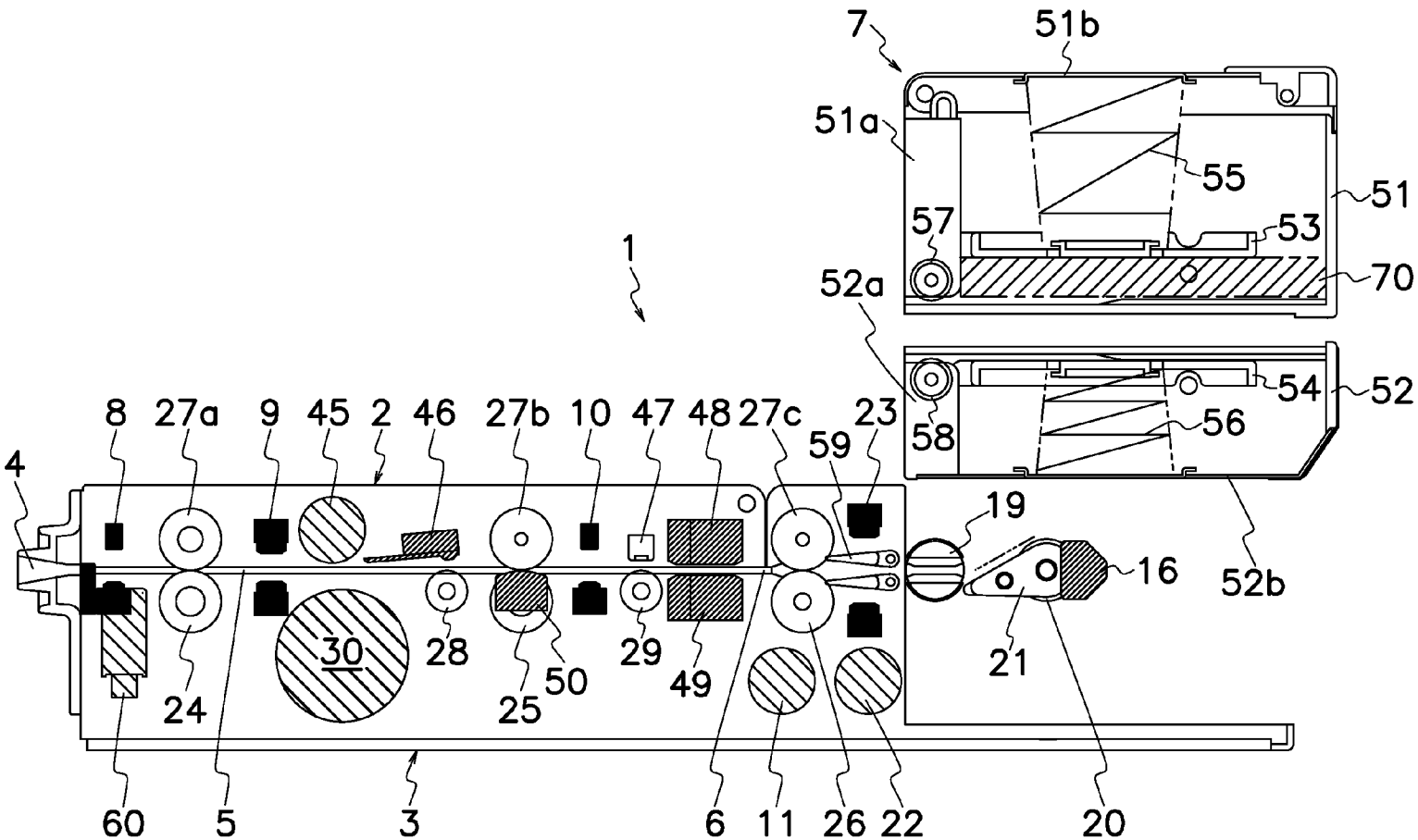
[FIG. 43] A sectional view of the card printer making up the card printing/stacking device according to the present invention with the stacker removed from the card printer.

Transport means T comprises an inlet sensor 8 for detecting card 70 inserted into inlet 4 of passageway 5 to produce a detection signal to controller IC, and a conveyor C driven by controller IC in response to a detection signal from inlet sensor 8 for transporting card 70 along passageway 5. Conveyor C comprises a feed motor 30, and various gears, belts, rollers and their associated components all drivingly connected to feed motor 30. For example, transport means T comprises a pair of inlet rollers 24 and 27*a* arranged behind inlet sensor 8 on opposite sides of passageway 5, an anterior sensor 9 arranged in the vicinity of passageway 5 behind inlet rollers 24, 27*a* for detecting passage of card 70, a pair of intermediate rollers 25, 27*b* arranged behind anterior sensor 9 on opposite sides of passageway 5, an intermediate sensor 10 arranged behind intermediate rollers 25, 27*b* in the vicinity of passageway 5 for detecting passage of card 70, a pair of posterior rollers 26, 27*c* arranged behind intermediate sensor 10 on opposite sides of passageway 5, a posterior sensor 23 arranged behind posterior rollers 26 and 27*c* on opposite sides of passageway 5, a pair of flaps 59*a*, 59*b* located behind posterior rollers 26, 27*c* and operated independently of each other, a rotary guide device RD provided with a rotary guide 19 rotatably mounted in stacker 7, a stack roller device SR provided with a stack roller 20 rotatably mounted in stacker 7, and a guide device G provided with a deflector 21 swingably mounted in stacker 7. FIG. 43 illustrates detachably and separate attachment of a storage 51 and a collection device 52 of stacker 7 with respect to card printer 1.

Reading means R comprises a magnetic sensor such as a magnetic head 50, a Hall sensor or combination thereof for magneto-electrically detecting information magnetically recorded or printed on card 70 and an optical sensor such as an image sensor, photo-couplers, a CCD camera or combination thereof for photo-electrically detecting information recorded or printed in color on card 70.

Printing means P capable of erasably printing information on card 70, comprises a thermal printer head 46 disposed in the vicinity of passageway 5 for thermally printing information on a partly heated area of card 70, a head driver 45 for moving printer head 46 between the print position adjacent to passageway 5 and the rest position away from passageway 5, and an eraser head 47 disposed in the vicinity of passageway 5 for thermally erasing information on a partly heated area of card 70.

Figure 3:
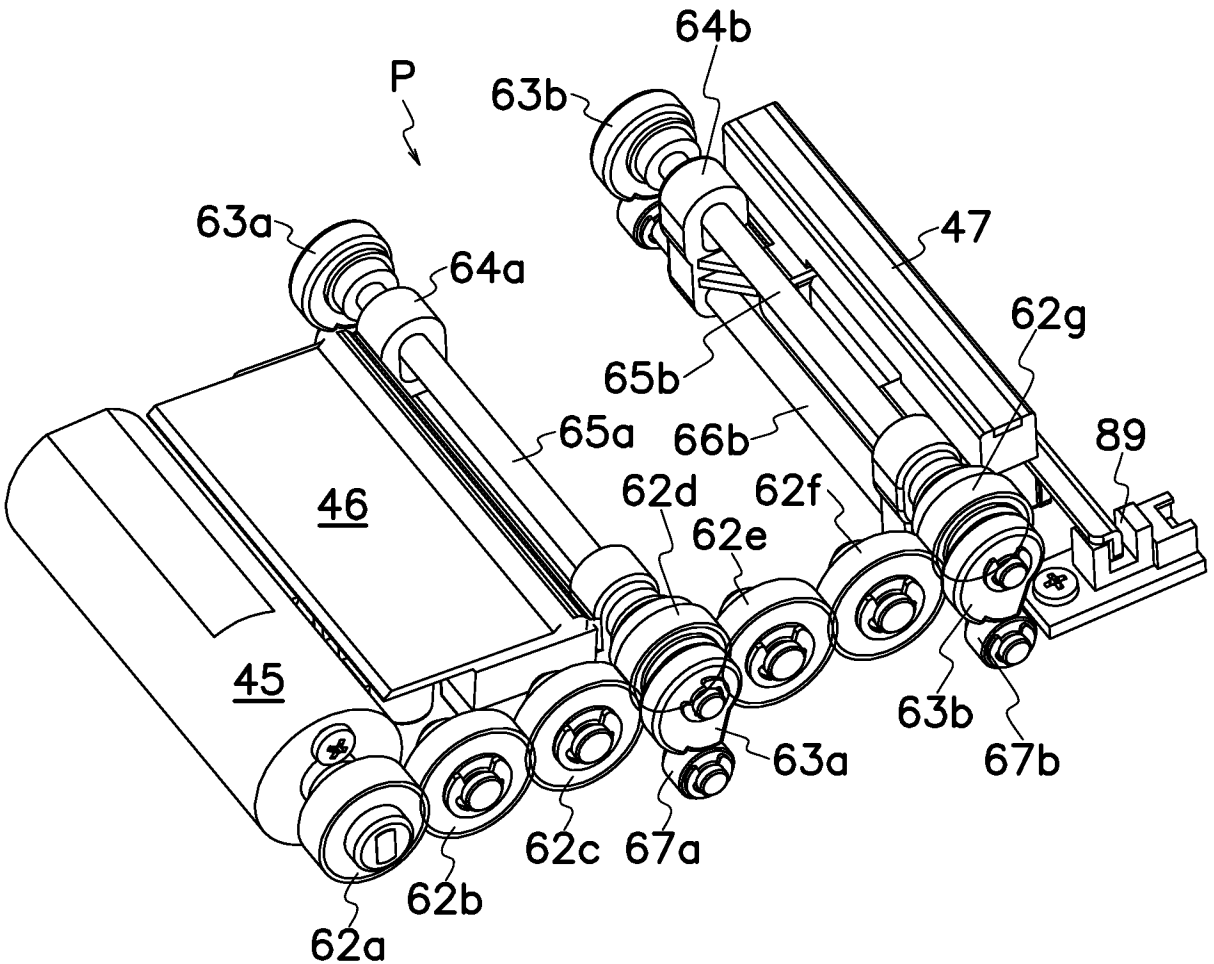
[FIG. 3] A perspective view of a head driver for moving a printer head attached to the card printer shown in FIG. 1.
Figure 4:
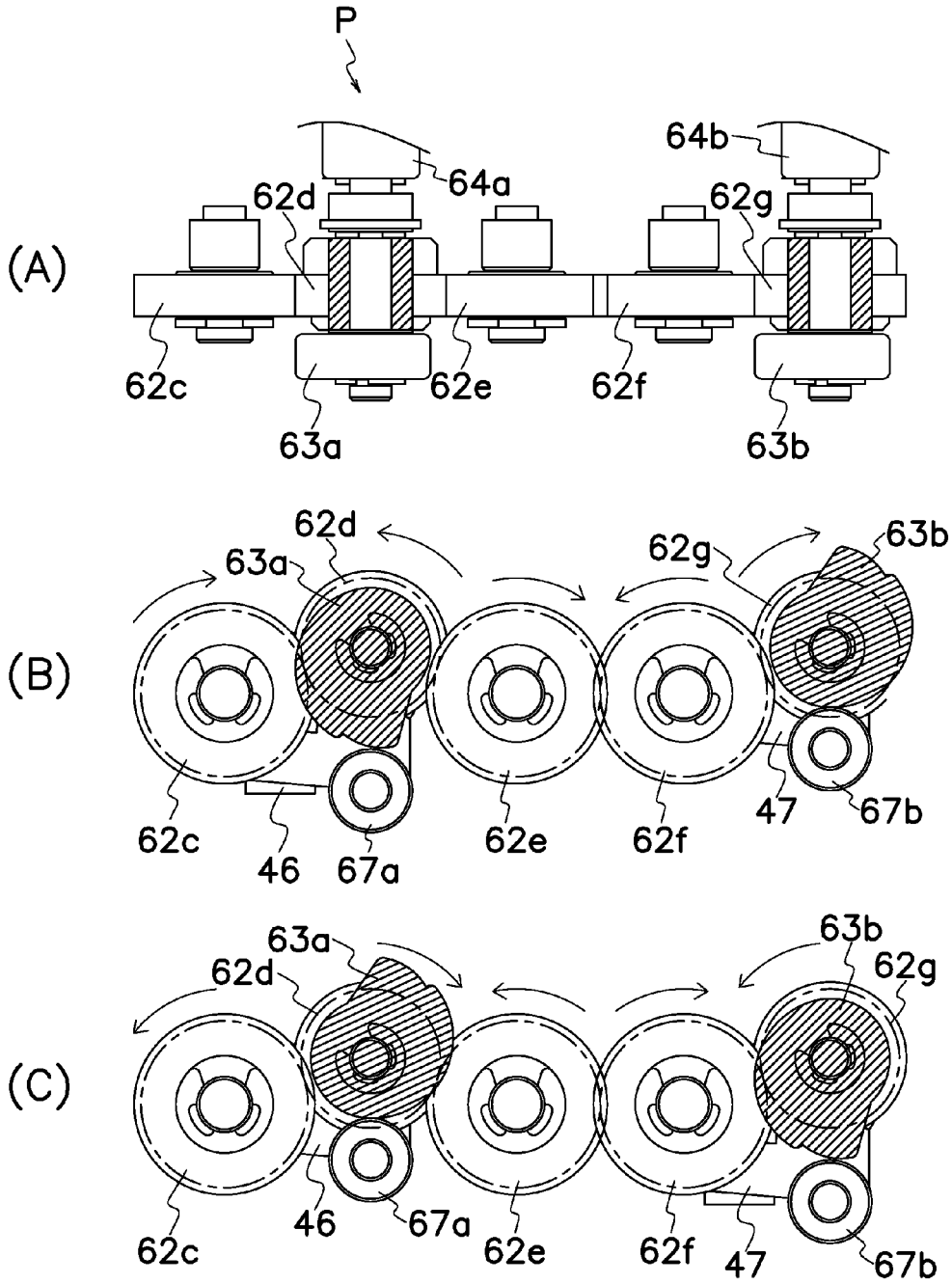
[FIG. 4] Perspective plan and side elevation views of a drive mechanism making up the head driver shown in FIG. 3.
Figure 5:
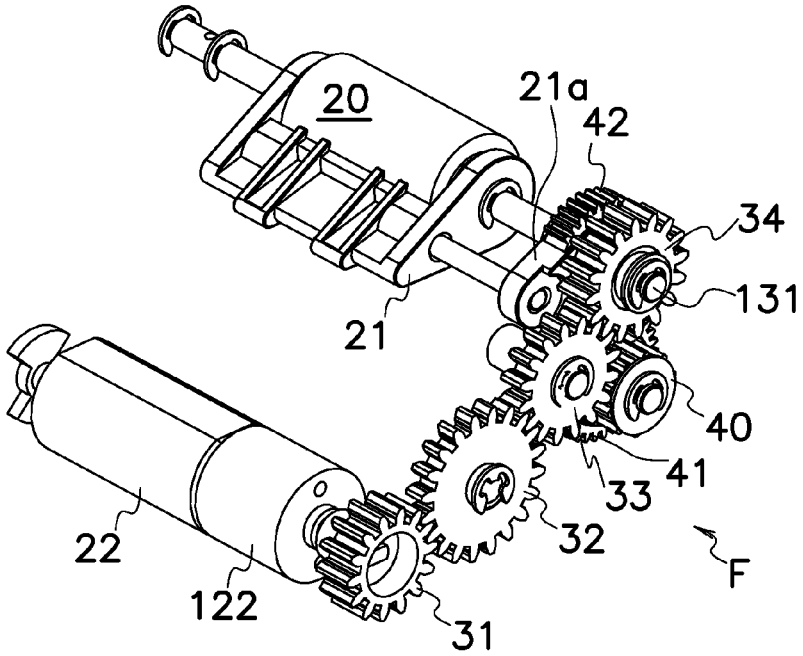
[FIG. 5] A perspective view from the left side of a power transmitter for stack rollers.
Figure 6:
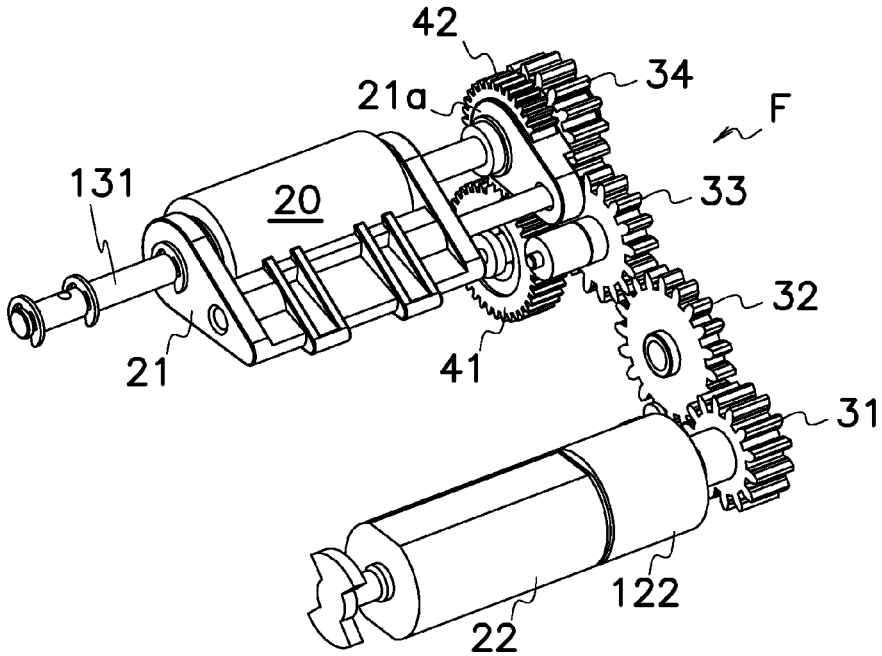
[FIG. 6] A perspective view from the right side of the power transmitter for the stack rollers.

FIG. 3 illustrates a perspective view of printing means P; FIG. 4 (A) is a plan view of printing means P; FIG. 4 (B) is a side elevation view of thermal printer head 46 moved to the lower position; and FIG. 4 (C) is a side elevation view of thermal printer head 46 moved to the upper position. Printing means P comprises a head motor (head driver) 45, an output gear 62*a* mounted on an output shaft of head motor 45, a cam gear 62*d* rotatably supported and secured on a cam shaft 65*a* in driving connection with output gear 62*a* through gears 62*b*, 62*c*, a pair of print cams 63*a* mounted on the opposite ends of cam shaft 65*a*, and a pair of print collars 67*a* in contact to each outer surface of print cams 63*a*. Print collars 67*a* may vertically move due to rotation of head motor 45 and print cams 63*a*. Print collars 67*a* are always upwardly urged to be in contact to print cams 63*a* by elastic biasing means such as springs not shown. Opposite ends of printer head 46 are connected to collars 67*a* for their integrally vertical movement so that printer head 46 may move between the lower position shown in FIG. 4 (B) to be in contact to card 70 passing through passageway 5 and the upper position shown in FIG. 4 (C) away from card 70 in accordance with vertical movement of collars 67, and this will be reviewed regarding the operation in Step 135 of FIG. 34. A thermal sensor 88 (FIG. 44) has a similar structure as that of an eraser sensor 89 for detecting printer head 46 in the lower position to produce a detection signal to control means IC.

Printing means P also comprises intermediate gears 62*e*, 62*f*, 62*g* drivingly connected to head motor 45 through cam gear 62*d*, an eraser shaft 65*b* having a final gear 62*g* at one end thereof, a pair of eraser cams 63*b* mounted on opposite ends of eraser shaft 65*b*, a pair of eraser collars 67*b* in contact to each outer surface of eraser cams 63*b*, and an eraser head 47 having opposite ends connected to eraser collars 67*b*. Eraser collars 67*b* are always upwardly urged to be in contact to eraser cams 63*b* by elastic biasing means such as springs not shown. Accordingly, rotation of head motor 45 leads to a rotation of eraser cams 63*b* to vertically move eraser head 47 between the lower position in contact to card 70 passing through passageway 5 and the upper position away from card 70. An eraser sensor 89 detects eraser head 47 in the lower position to produce a detection signal to control means IC. Accordingly, as shown in FIG. 4 (B) rotation of head motor 45 leads to movement of printer head 46 to the lower position to write information on card 70 while eraser head 47 is moved to the upper position. On the contrary, as shown in FIG. 4 (C), adverse rotation of head motor 45 leads to movement of printer head 46 to the upper position while eraser head 47 is moved to the lower position to erase information on card 70. Detailed operations of printing means P will be described with reference to Step 129 and subsequent Steps in FIG. 34.

Figure 11:
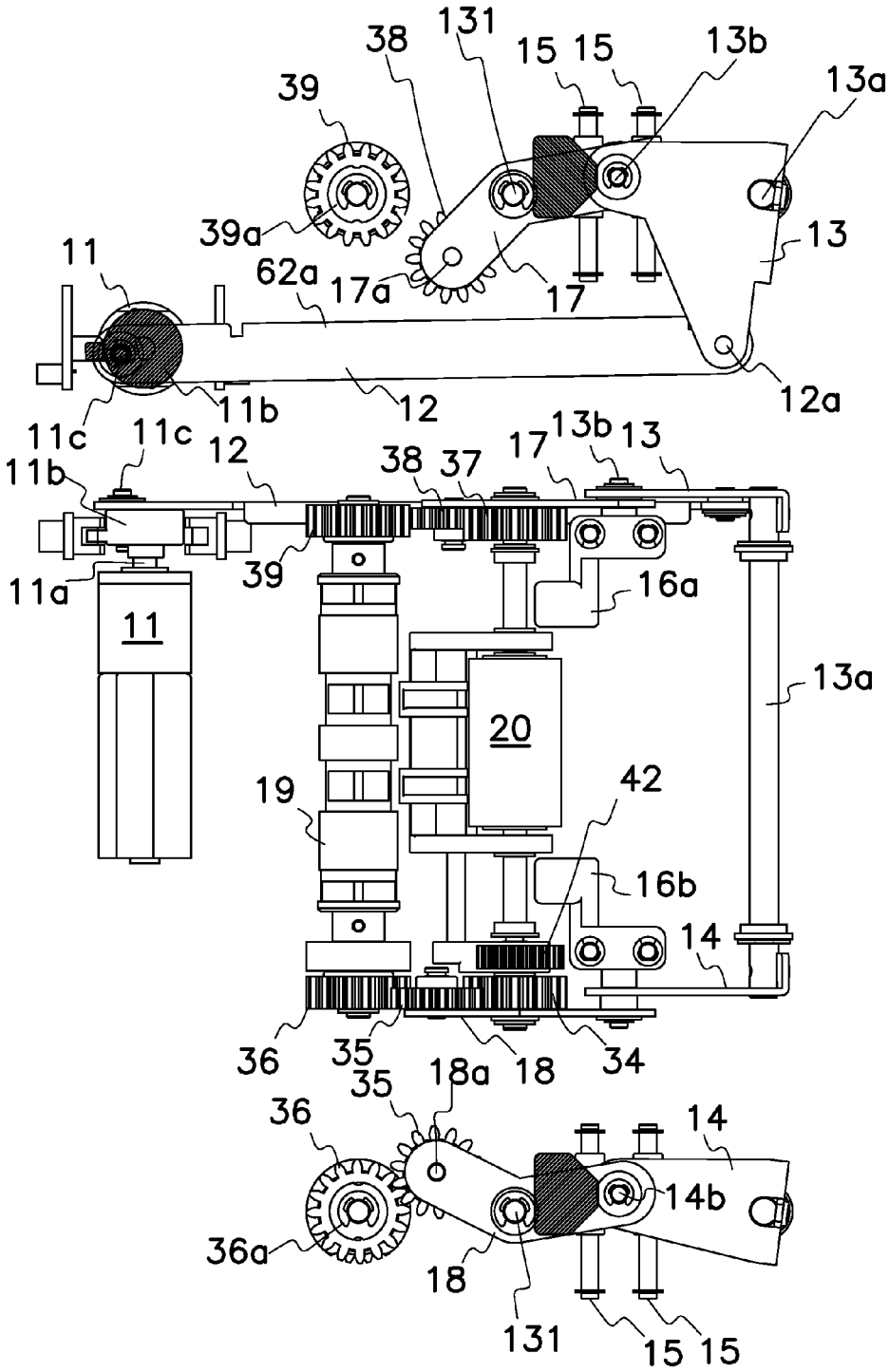
[FIG. 11] Plan and side elevation views showing the retainer for urging cards and power transmitter of stack rollers while rotating the rotary guide in one direction.
Figure 12:
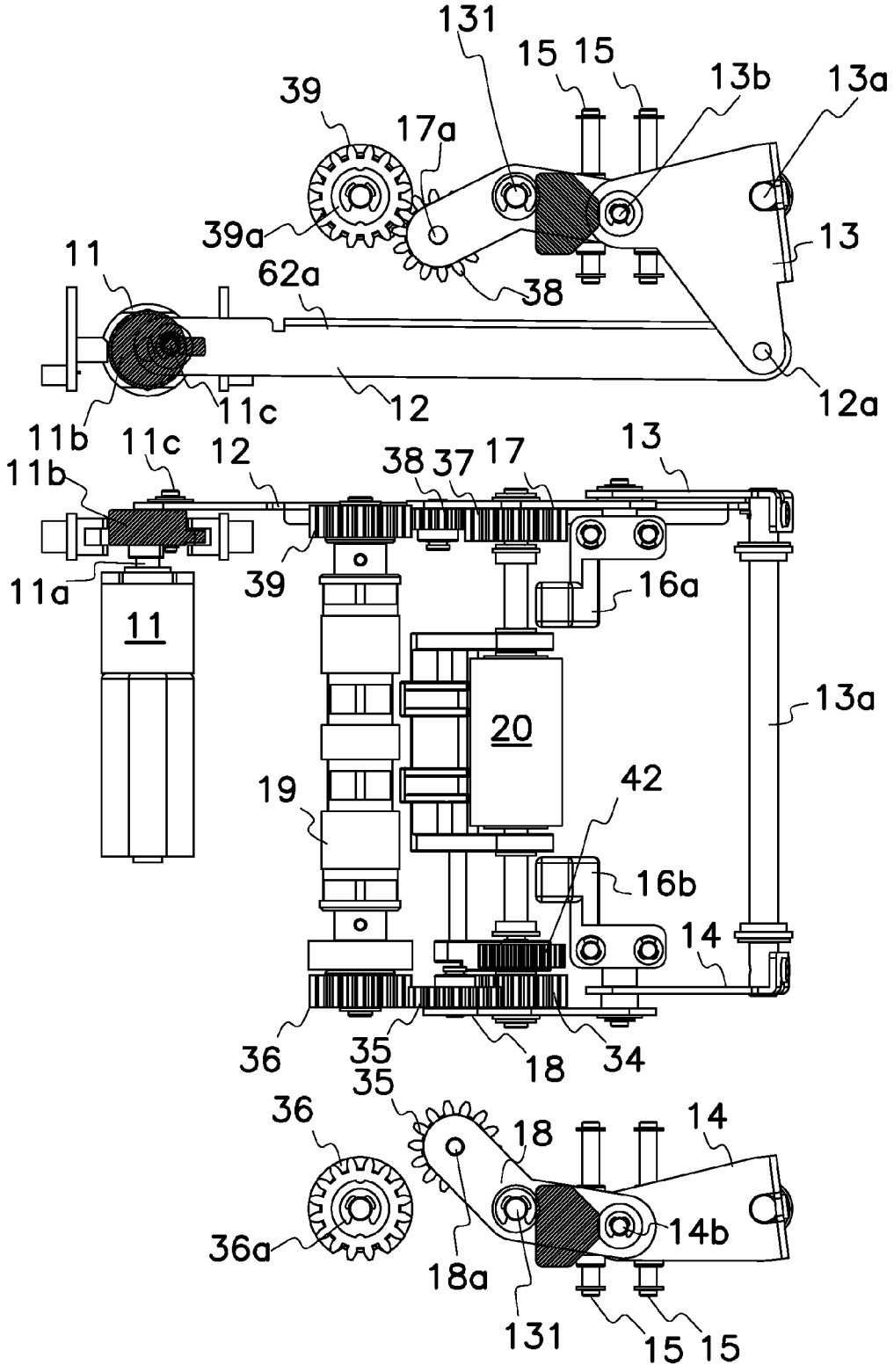
[FIG. 12] Plan and side elevation views showing the retainer for urging cards and power transmitter of stack rollers while rotating the rotary guide in the other direction.
Figure 13:
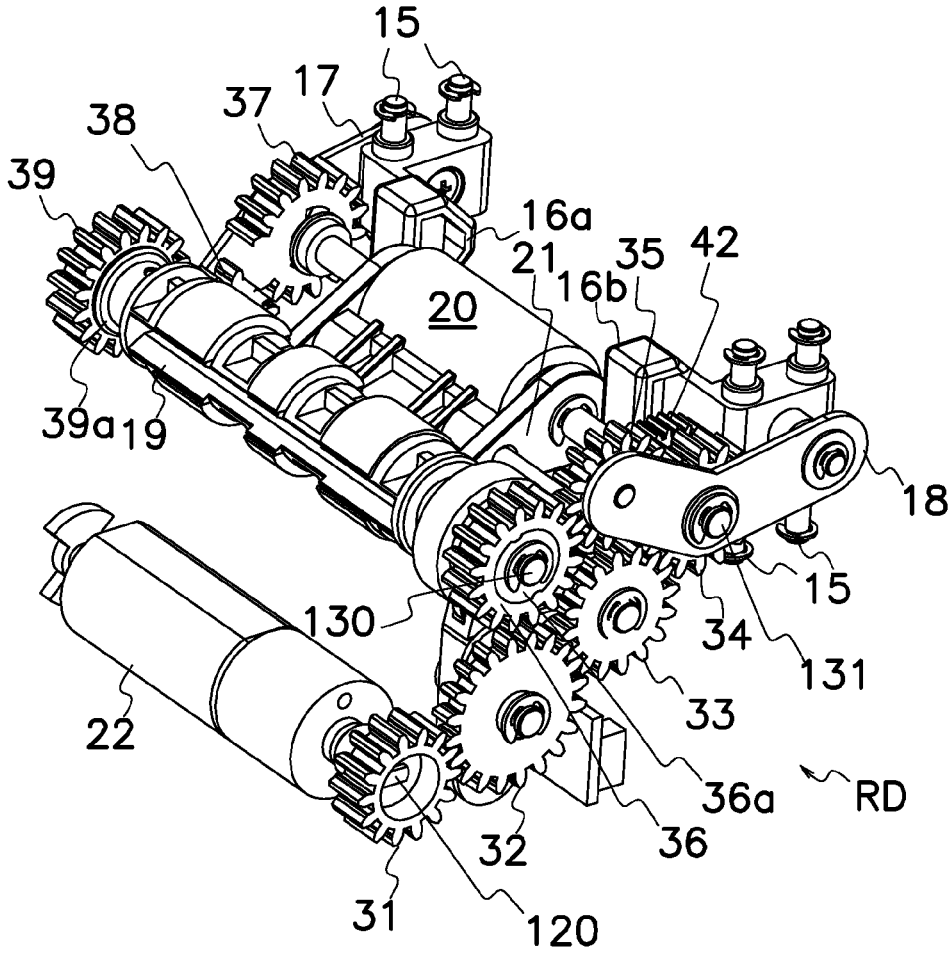
[FIG. 13] A perspective view from the left side showing a drive device for the rotary guide.
Figure 14:
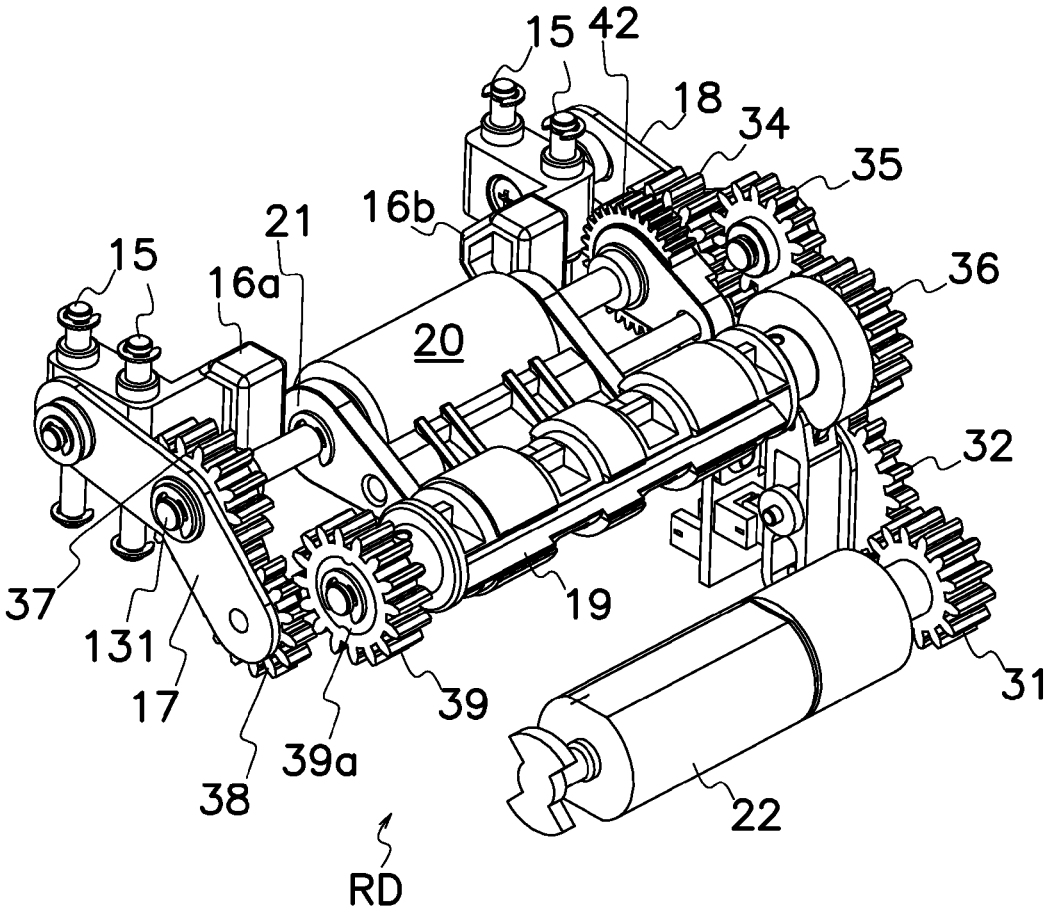
[FIG. 14] A perspective view from the right side showing the drive device for the rotary guide.
Figure 15:
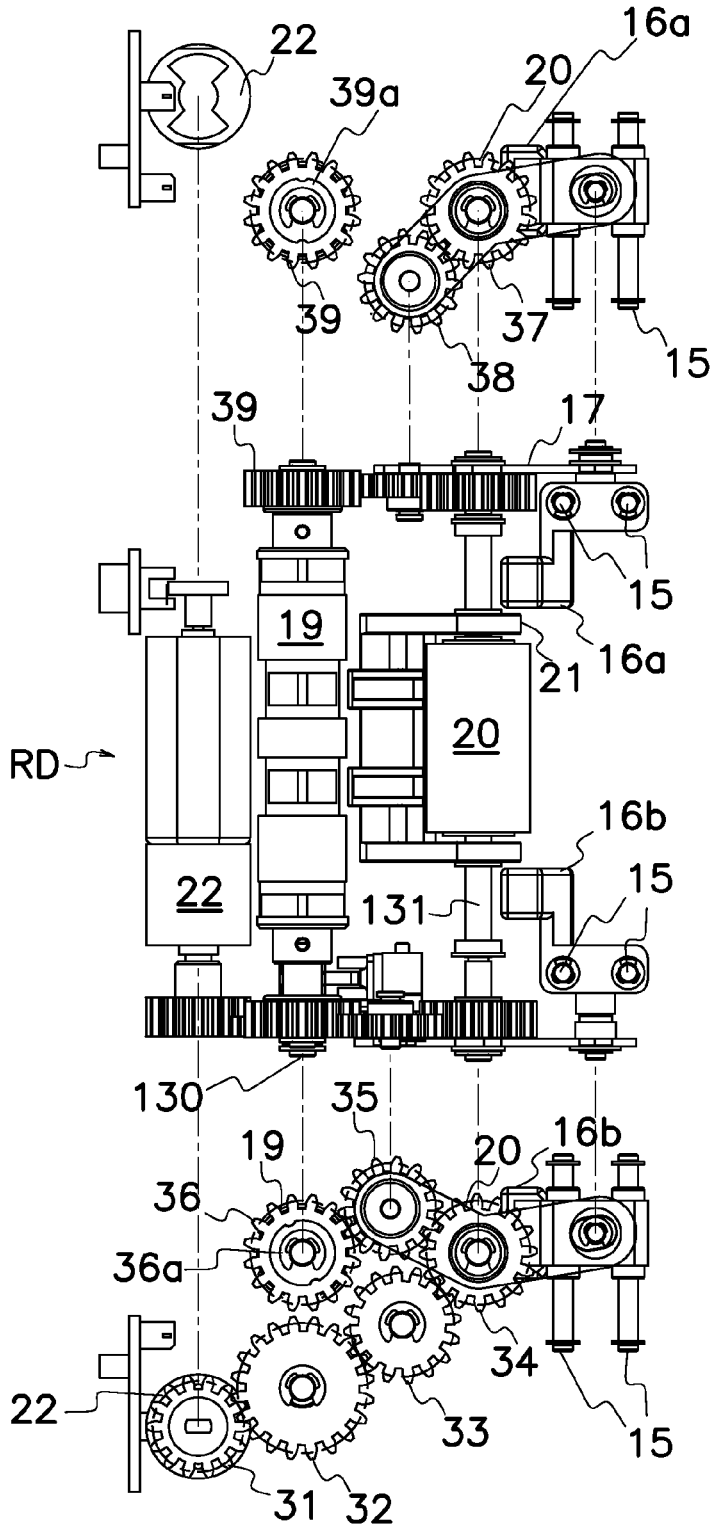
[FIG. 15] Plan and side elevation views of the drive device for the rotary guide.

As seen in FIGS. 11 and 12, retainer means H comprises a retention motor 11 arranged in card printer 1, a disk 11*b* secured on a drive shaft 11*a* of retention motor 11, and an eccentric pin 11*c* fixed on disk 11*b*. Eccentric pin 11*c* is pivotally connected to one end of a connecting rod 12 the other end of which is pivotally connected to one end of a first bell crank 13 by a shaft 12*a*. First bell crank 13 is rotatably mounted on a horizontal connecting shaft 13*a*, and the other end of first bell crank 13 is pivotally connected to one end of a first lever 17 via a shaft 13*b*. First lever 17 is rotatably mounted around a lever shaft 131, and a first movable gear 38 is rotatably attached to the other end of first lever 17 by a shaft 17*a*. A second bell crank 14 is secured to the other end of connecting shaft 13*a* for integral rotation of second bell crank 14 and connecting shaft 13*a*. The other end of second bell crank 14 is pivotally connected via a shaft 14*a* to one end of a second lever 18 that is rotatably mounted on and around lever shaft 131, and a second movable gear 35 is rotatably attached to the other end of second lever 18 via a shaft 18*a*.

When retention motor 11 rotates in the forward direction, connecting rod 12 moves toward retention motor 11, and first bell crank 13 rotates around connecting shaft 13*a* in the clockwise direction, and so, first lever 17 rotates in the counterclockwise direction to bring first movable gear 38 away from a first guide gear 39 mounted at one end of a rotary guide 19. Simultaneously, second bell crank 14 fixed on shaft 13*a* rotates in the clockwise direction to cause second lever 18 to rotate in the counterclockwise direction to bring second movable gear 35 closer to and in engagement with a second guide gear 36 mounted on the other end of rotary guide 19. As shaft 13*b* moves upward due to rotation of first bell crank 13 in the clockwise direction, a first holder 16*a* mounted on shaft 13*b* upwardly moves to the upper position along vertical guides 15. At the same time, as shaft 14*b* upwardly moves due to rotation of second bell crank 14 in the clockwise direction, a second holder 16*b* fixed on a shaft 14*b* upwardly moves along guides 15. For illustrative convenience, first and second holders 16*a* and 16*b* are collectively referred to as holders 16 as necessary.

When retention motor 11 rotates in the adverse direction, connecting rod 12 moves away from retention motor 11, and as shown in FIG. 12, first bell crank 13 rotates around connecting shaft 13*a* in the counterclockwise direction, and so, first lever 17 rotates in the clockwise direction to bring first movable gear 38 closer to and in engagement with first guide gear 39. Concurrently, second bell crank 14 fixed on shaft 13*a* rotates in the counterclockwise direction to cause second lever 18 to rotate in the clockwise direction to bring second movable gear 35 away from second guide gear 36. As shaft 13*b* moves downward due to rotation of first bell crank 13 in the counterclockwise direction, first holder 16*a* on shaft 13*b* downwardly moves to the lower position along guides 15. At the same time, as shaft 14*b* downwardly moves due to rotation of second bell crank 14 in the counterclockwise direction, second holder 16*b* mounted on shaft 14*b* downwardly moves along guides 15. A linkage L is made up of disk 11*b*, connecting rod 12, first and second bell cranks 13 and 14, first and second levers 17 and 18.

Figure 8:
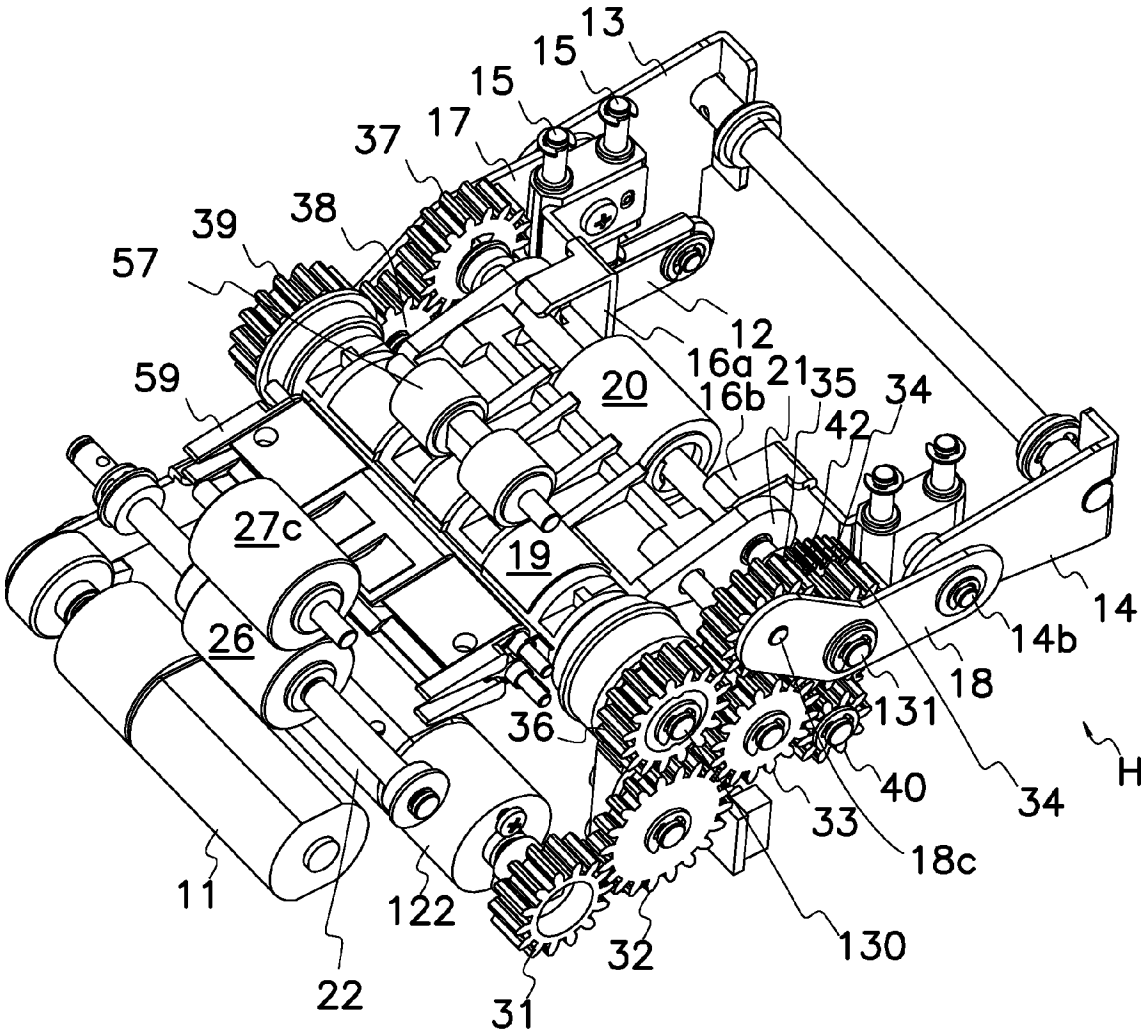
[FIG. 8] A perspective view indicating a rotary guide, a retainer for urging cards and the power transmitter of a stack roller.

To drive rotary guide 19 and stack roller 20 shown in FIG. 8, a stack motor 22 has an output shaft drivingly connected to a deceleration device 122 to transmit rotation power of deceleration device 122 to lever shaft 131 through gears 31, 32, 33. Swingably mounted on lever shaft 131 is second lever 18 which has one end rotatably connected to a shaft 14*b* for supporting second holder 16*b* and the other end provided with a shaft 18*c* for rotatably supporting second movable gear 35 meshed with a roller gear 34 for transmission of rotative power from roller gear 34 to second movable gear 35.

Rotary guide 19 is secured on a guide shaft 130 through a one-way clutch not shown, and second guide gear 36 is attached to one end of guide shaft 130. When second holder 16*b* is in the lower position shown in FIG. 11, second lever 18 is swung downwardly around lever shaft 131 to render second movable gear 35 meshed with second guide gear 36. At the moment, first bell crank 13 rotates in the clockwise direction to rotate first lever 17 in the counterclockwise direction around lever shaft 131 to thereby bring first movable gear 38 closer to and in engagement with first guide gear 39 as shown in FIG. 12. In other words, when first and second holders 16*a* and 16*b* are in the upper position as shown in FIG. 11, second movable gear 35 can transmit its rotative force to second guide gear 36 but first movable gear 38 is kept away from first guide gear 39. Adversely, when first and second holders 16*a* and 16*b* are in the lower position as shown in FIG. 12, second movable gear 35 is kept away from second guide gear 36 but first movable gear 38 can transmit its rotative force to first guide gear 39.

Figure 7:
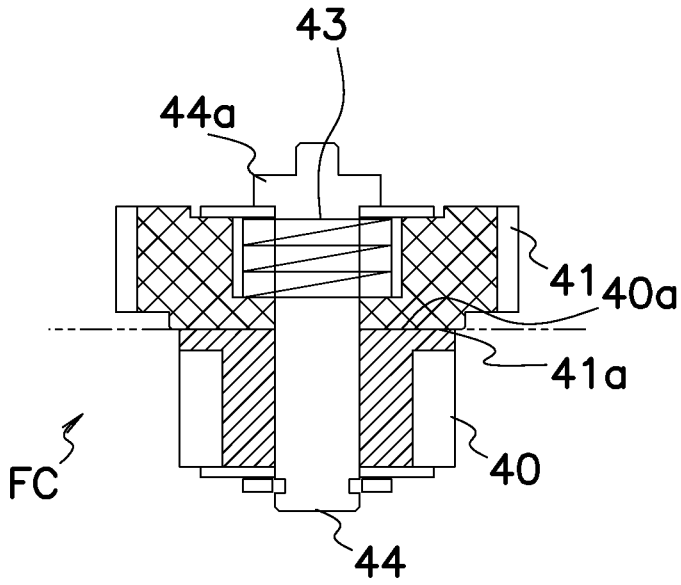
[FIG. 7] A sectional view of a clutch mounted in the power transmitter.

A frictional clutch FC shown in FIG. 7 is provided between a frictional surface 40*a* of a drive gear 40 rotatably mounted on a shaft 44 and a mating frictional surface 41*a* of a follower gear 41. Disposed between a flange 44*a* of shaft 44 and follower gear 41 is a spring (biasing member) 43 that always resiliently urges follower gear 41 toward drive gear 40 under a constant pressure. In the usual condition, drive gear 40 is integrally incorporated with follower gear 41 due to frictional force between them under resilient force by spring 43 to rotate together with follower gear 41 as a unit when drive gear 40 receives rotative force from gear 33. When drive gear 40 is given a torque greater than frictional force between drive and follower gears 40 and 41 by spring 43, frictional clutch FC produces a slippage between frictional surfaces 40*a* and 41*a* of drive and follower gears 40 and 41 to stop rotation of follower gear 41.

Figure 16:
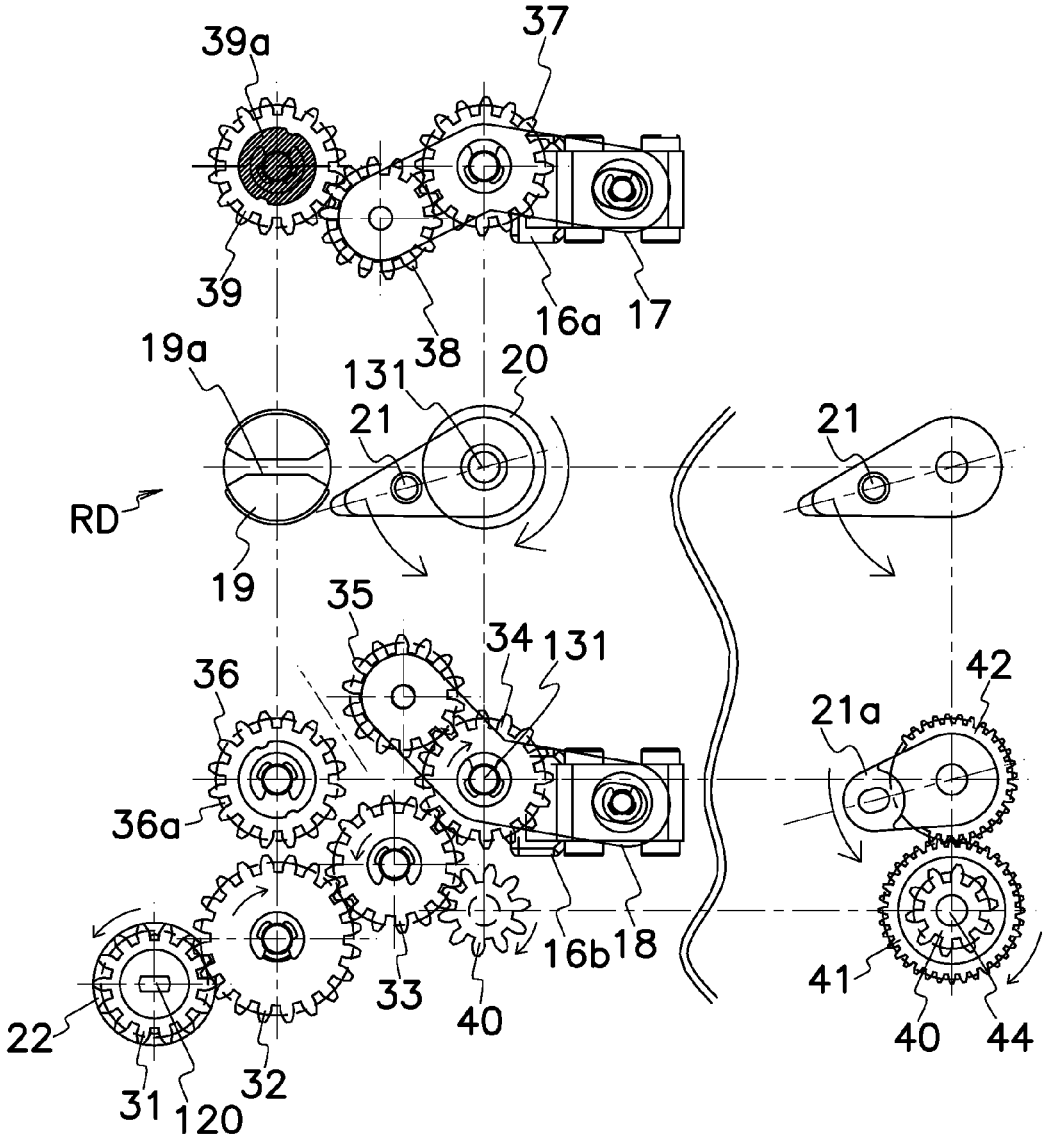
[FIG. 16] A side elevation view of the drive device for stowing a card into a storage while rotating the rotary guide in one direction.

As illustrated in FIG. 16, gear 33 is interlocked with drive gear 40 rotated around shaft 44; drive gear 40 is drivingly connected to follower gear 41 through frictional clutch FC; follower gear 41 is meshed with a deflector gear 42 rotatably mounted on lever shaft 131; and a deflector 21 is secured on one side of deflector gear 42.

Figure 9:
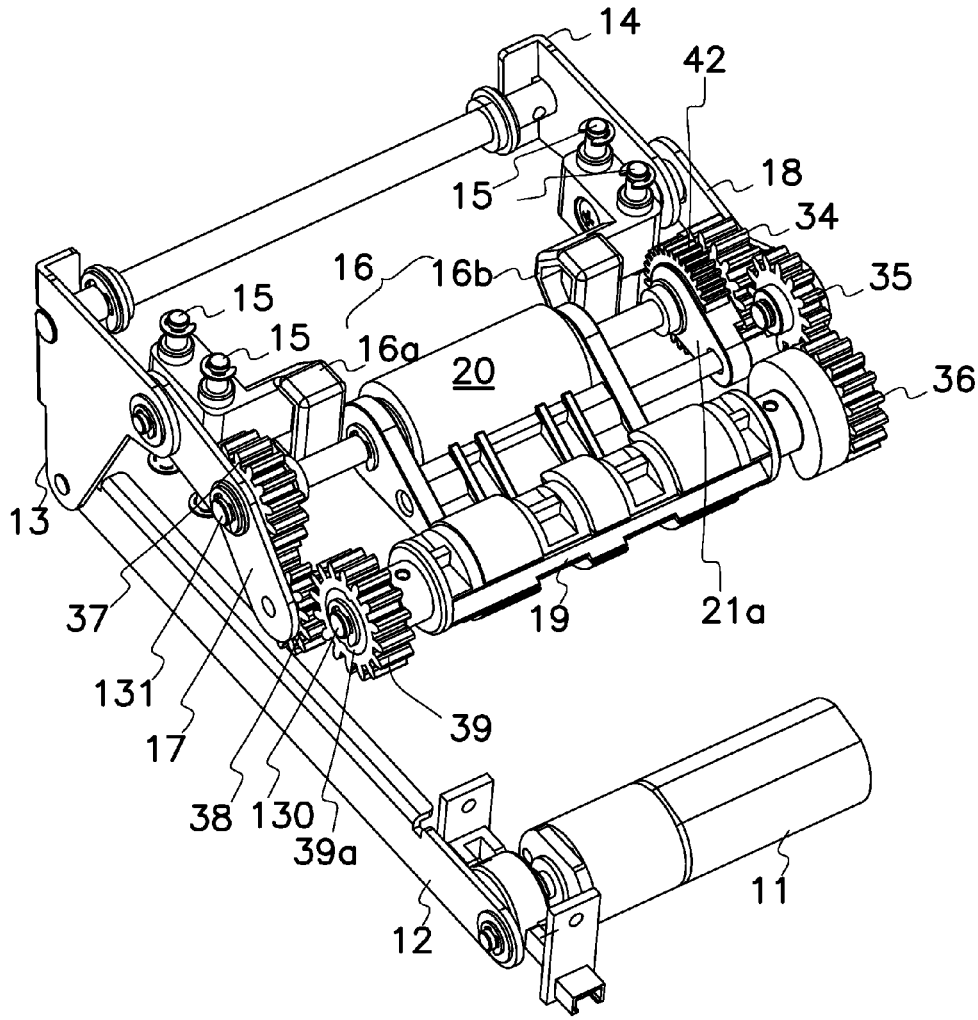
[FIG. 9] A perspective view of the retainer.
Figure 10:
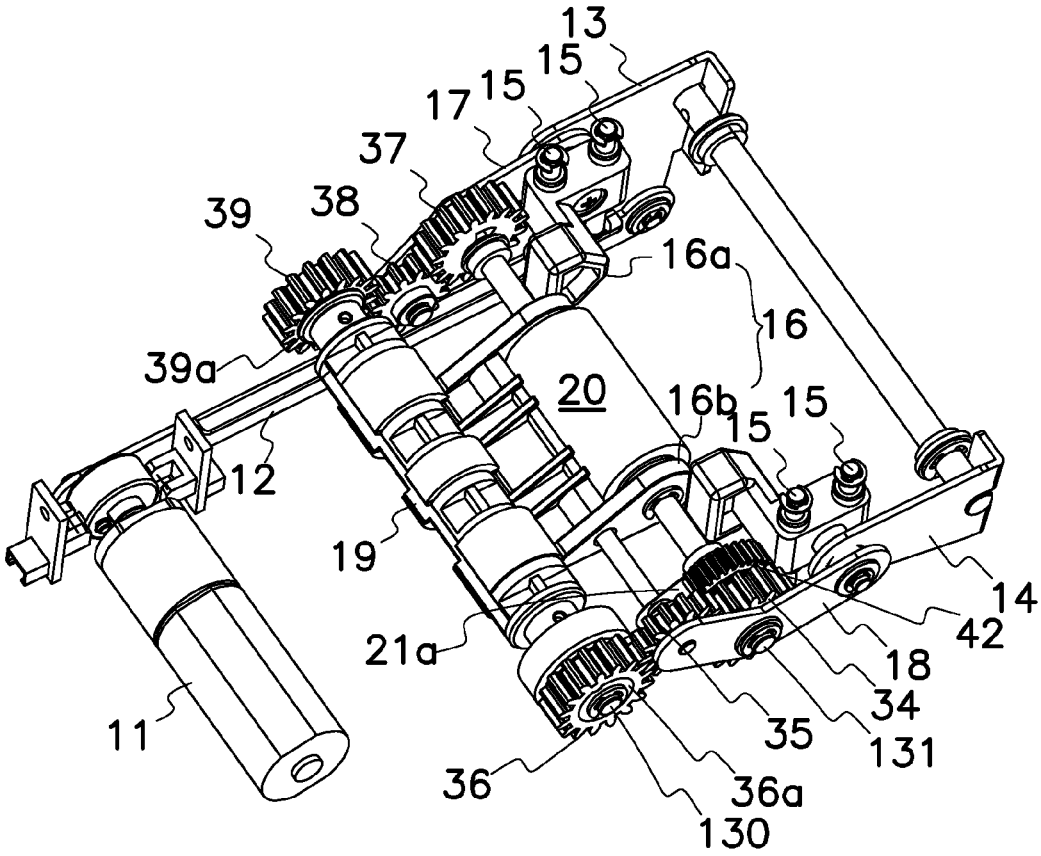
[FIG. 10] A perspective view showing the retainer and power transmitter in FIG. 8 upon removal of the rotary guide.

To rotate rotary guide 19 and stack roller 20, as shown in FIG. 8, lever shaft 131 has one end connected to second lever 18 and roller gear 34 and the other end connected to a gear 37 and first lever 17 for its pivotal movement. As seen in FIG. 9, first lever 17 has one end pivotally connected to first bell crank 13 via a movable shaft 13*b* and the other end connected to a shaft 17*a* for rotatably supporting first movable gear 38. First holder 16 is attached to movable shaft 13*b* for their vertical movement. When first holder 16*a* is in the upper position, first movable gear 38 is engaged with first guide gear 39 to transmit rotative force from first movable gear 38 to first guide gear 39 that rotates rotary guide 19 through a one-way clutch not shown. This configuration ensures rotation of rotary guide 19 by drive power of stack motor 22 through second movable gear 35 and second guide gear 36 when first holder 16*a* is in the upper position. When first holder 16*a* is in the lower position, drive power of stack motor 22 is not fed to rotary guide 19, but is fed to lever shaft 131 and stack roller 20 mounted on lever shaft 131 through gears 31 to 34. Power transmitter F is made up of a plurality of gears for transmitting rotative force of stack motor 22 to stack roller 20.

Rotative power of stack motor 22 is transmitted through gears 31, 32, 33, drive gear 40 and follower gear 41 in frictional clutch FC (FIG. 7) and deflector gear 42 (FIG. 16) to deflector 21 mounted on lever shaft 131 of deflector gear 42. Rotation of deflector gear 42 results in integrally swinging movement of deflector lever 21*a* and deflector 21. After deflector 21 is rotated by a given angle, it comes into contact with a stopper not shown to block a further rotation of deflector 21 while producing a slippage in frictional clutch FC. Likewise, when deflector 21 is rotated in the adverse direction, it comes into contact with a stopper not shown to block a further rotation of deflector 21 while producing a slippage in frictional clutch FC.

To stow card into storage 51, when stack motor 22 rotates in the counterclockwise direction as shown in FIG. 16, gears 31, 32, 33 and 34 rotate in turn respectively in the counterclockwise, clockwise, counterclockwise and clockwise directions. At this time, stack roller 20 rotates integrally with shaft 131 bearing gear 34 in the clockwise direction, but deflector 21 comes into contact to a stopper not shown to block a further rotation of deflector 21 while producing slippage in frictional clutch FC. At that time, first and second holders 16*a* and 16*b* both are in the lower position as shown in FIG. 12, where second movable gear 35 is disengaged from second guide gear 36, but first movable gear 38 is engaged with first guide gear 39. Due to one-way clutch not shown, torque of first guide gear 39 cannot be transmitted to rotary guide 19 that is stopped in the condition for maintaining a slit 19*a* formed in rotary guide 19 in the horizontal position. At the moment, together with rotation of stack motor 22, gears 31, 32, 33 and 40 rotate respectively in the counterclockwise, clockwise, counterclockwise and clockwise directions and deflector gear 42 rotates in the counterclockwise direction through follower gear 41 to rotate deflector 21 to the downward direction as shown in FIG. 23.

Figure 23:
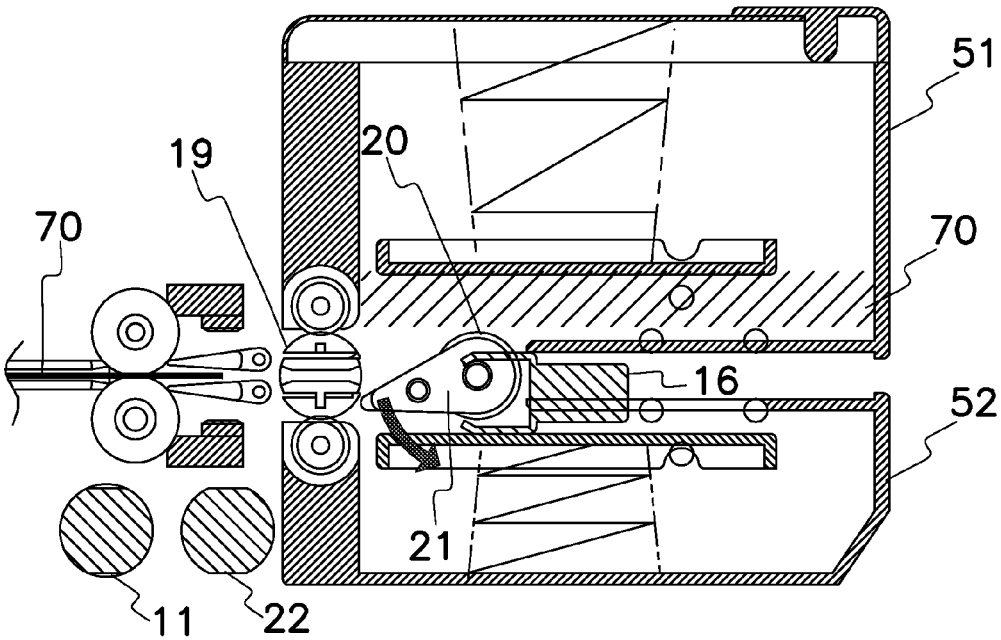
[FIG. 23] A sectional view of the stacker where a card is stowed into the storage.
Figure 24:
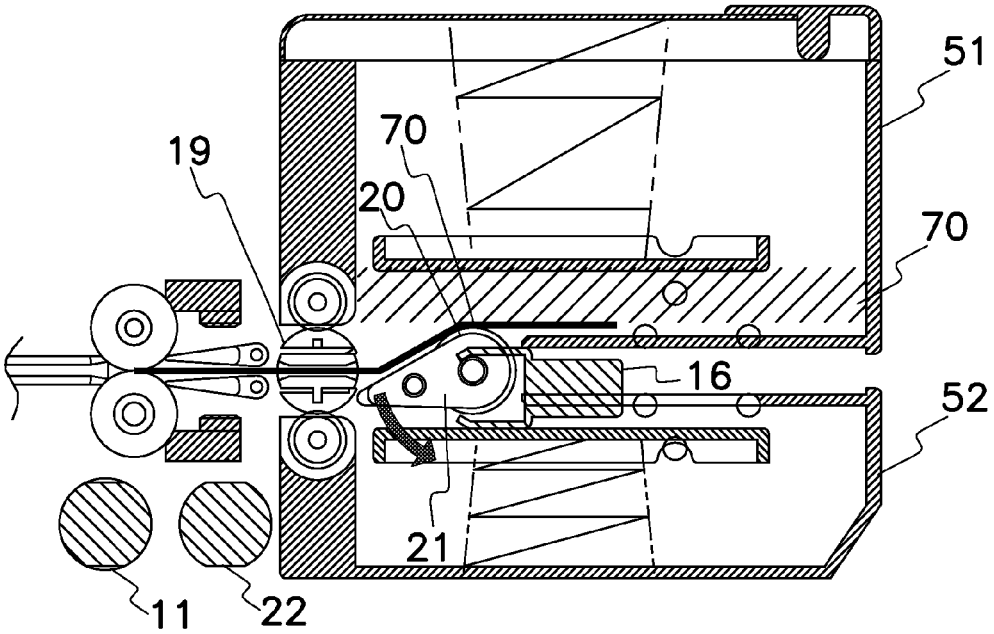
[FIG. 24] A sectional view of the stacker where a card is fed into the storage under the condition shown in FIG. 23.
Figure 25:
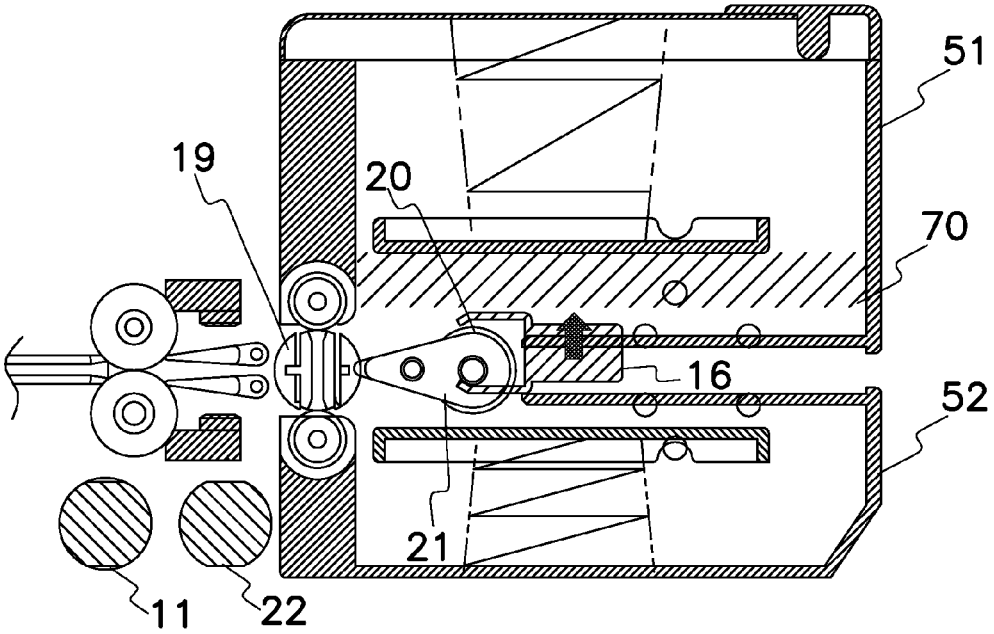
[FIG. 25] A sectional view of the stacker where the holders are moved to the upper position.

Under the circumstances, when card 70 is inserted into inlet 4 shown in FIG. 1, it is transported between posterior rollers 26 and 27*c* and between flaps 59*a* and 59*b* into slit 19*a* in rotary guide 19 as shown in FIG. 23. When a leading edge of card 70 passes slit 19*a* in rotary guide 19, card 70 is boosted up to the obliquely upward right along an upper surface of deflector 21 in the downward direction as shown in FIG. 24. When card 70 is carried further into the back, leading edge of card 70 comes into contact to stack roller 20, and rotation of stack roller 20 moves card 70 to the back of storage 51. When a control device IC (FIG. 44) counts a predetermined number of pulses or clock signals from a built-in timer in control device IC after a trailing edge of card 70 has passed posterior sensor 23, the device completes stowing of card 70 into storage 51 while stopping stack motor 22.

Figure 17:
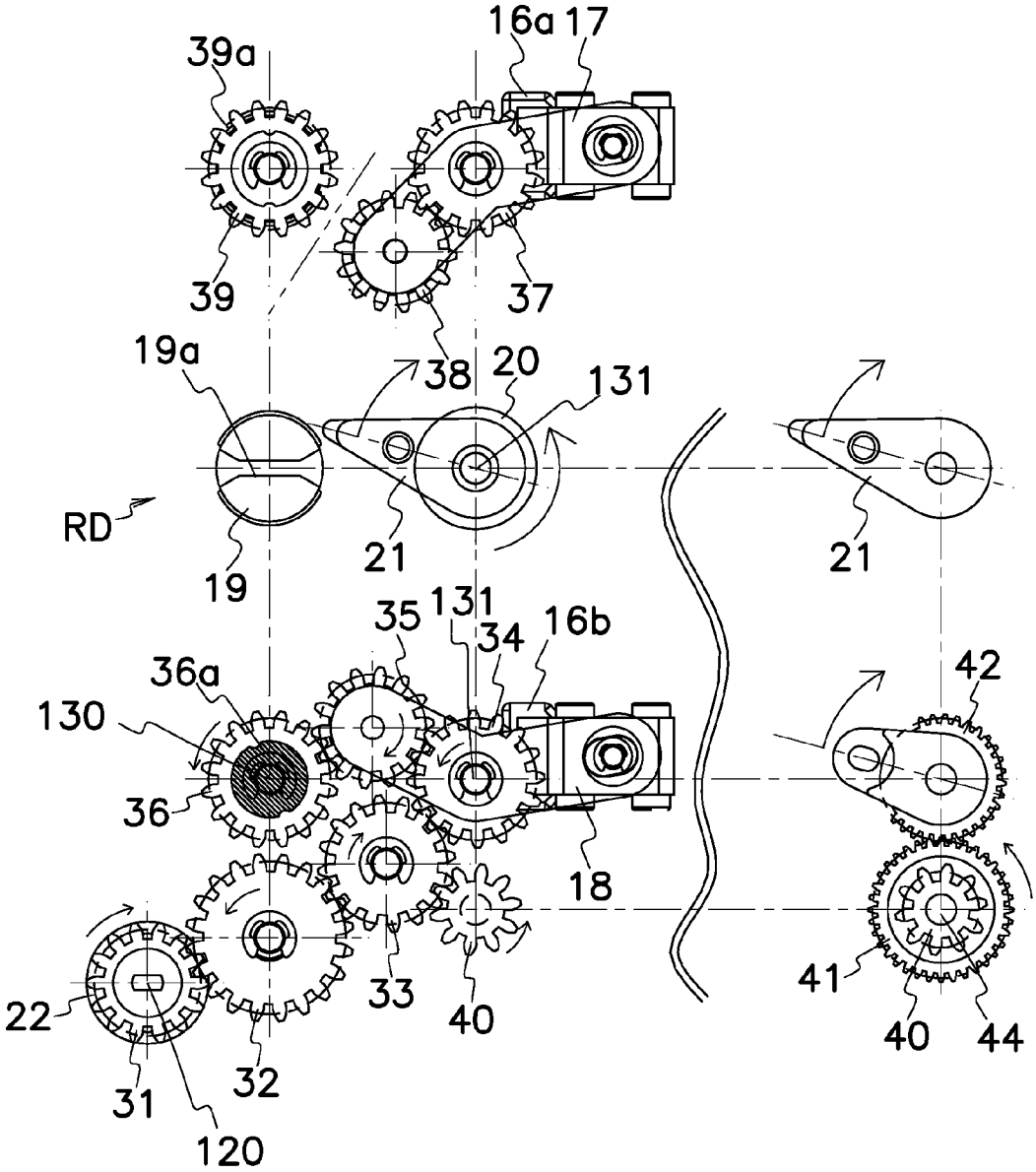
[FIG. 17] A side elevation view of the drive device for stowing a card into a collection device while rotating the rotary guide in the other direction.
Figure 26:
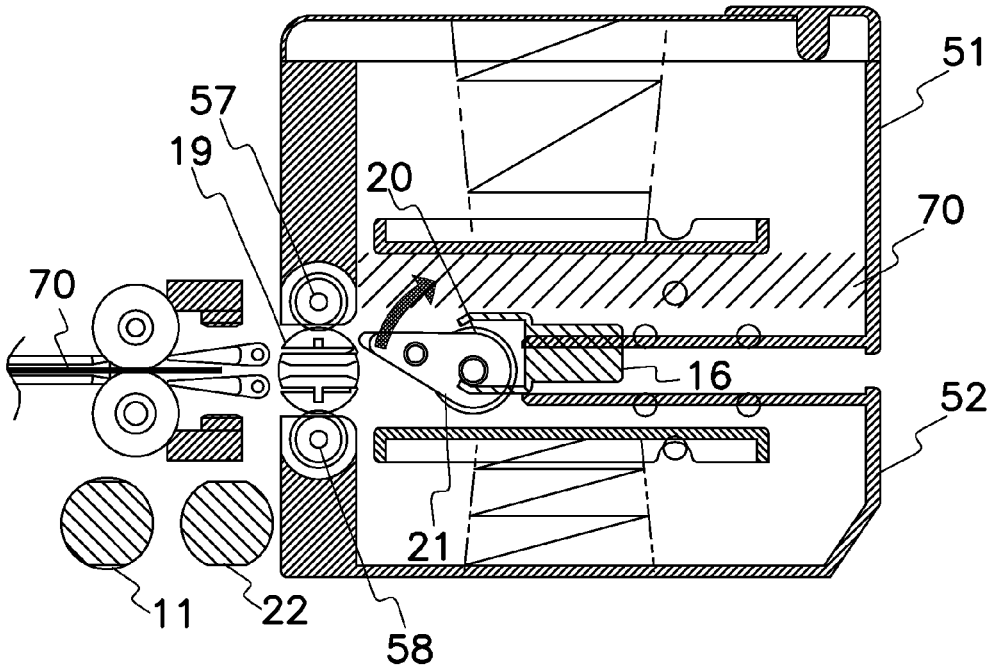
[FIG. 26] A sectional view of the stacker where a card is fed into the collection device.
Figure 27:
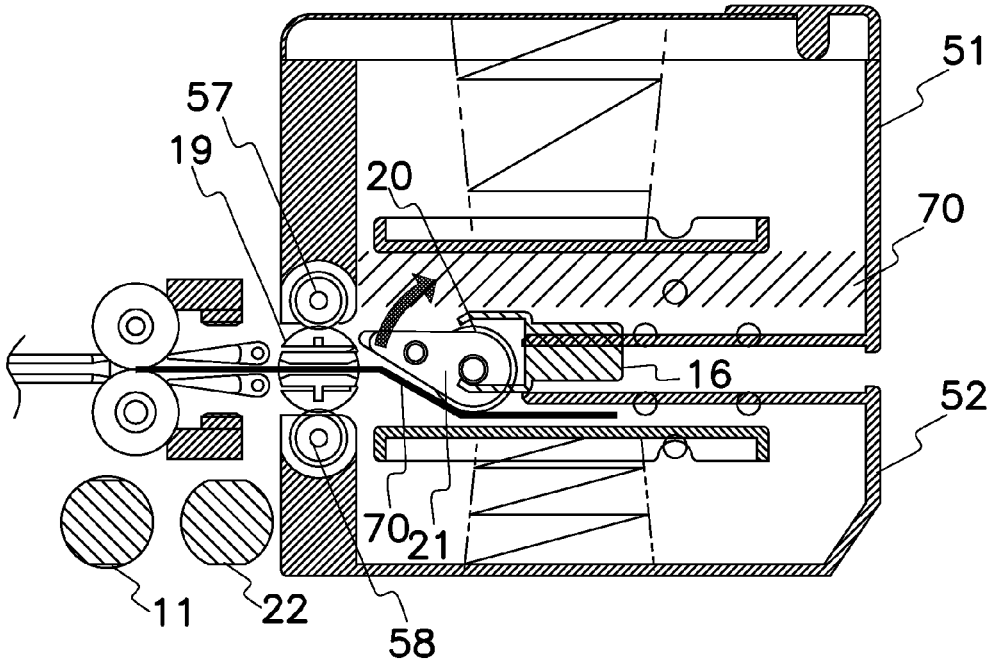
[FIG. 27] A sectional view of the stacker where a card is fed into the collection device under the condition shown in FIG. 26.
Figure 28:
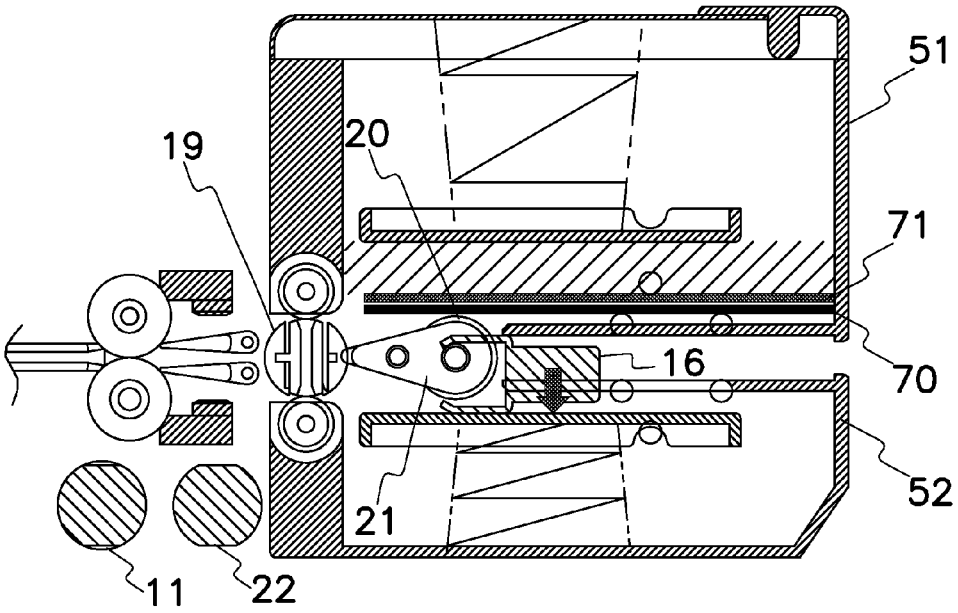
[FIG. 28] A sectional view of the stacker where the holders are moved to the lower position.

To stow card 70 into collection device 52 as shown in FIGS. 17, 26 and 27, stack motor 22 is rotated in the clockwise direction as illustrated in FIG. 17 to rotate gears 32, 33 and 34 drivingly connected in turn from gear 31 respectively in the counterclockwise, clockwise and counterclockwise directions while torque of gear 34 is transmitted for rotation of stack roller 20 in the counterclockwise direction through shaft 131. Then, as first and second holders 16*a* and 16*b* are in the upper position, rotation of gear 34 in the counterclockwise direction is transmitted for rotation of second movable gear 35 in the clockwise direction and further for rotation of second guide gear 36 in the counterclockwise direction. There, torque of second guide gear 36 is cut off by operation of one-way clutch to stop rotation of rotary guide 19 to maintain slit 19*a* in the horizontal condition. Rotation of stack motor 22 in the clockwise direction leads to rotations of gears 32, 33 and 40 respectively in the counterclockwise, clockwise and counterclockwise directions through gear 31. Rotation of drive gear 40 is conveyed to follower gear 41 through frictional clutch FC to rotate follower gears 41 and deflector gear 42 respectively in the counterclockwise and clockwise directions to swing deflector 21 to the upward direction as shown in FIGS. 26 and 27.

Card 70 grasped and moved between posterior rollers 27*c* and 26 passes between flaps 59*a* and 59*b* and through slit 19*a* of rotary guide 19. Leading edge of card 70 is brought into contact to deflector 21 and guided to the obliquely downward right. When leading edge of card 70 reaches stack roller 20, torque of stack roller 20 rotating in the counterclockwise direction is supplied to card 70 that is then conveyed to the back of collection device 52. When control device IC counts a predetermined number of pulses after trailing edge of card 70 has passed posterior sensor 23, the device completes stowing of card 70 into collection device 52 while stopping stack motor 22.

Figure 18:
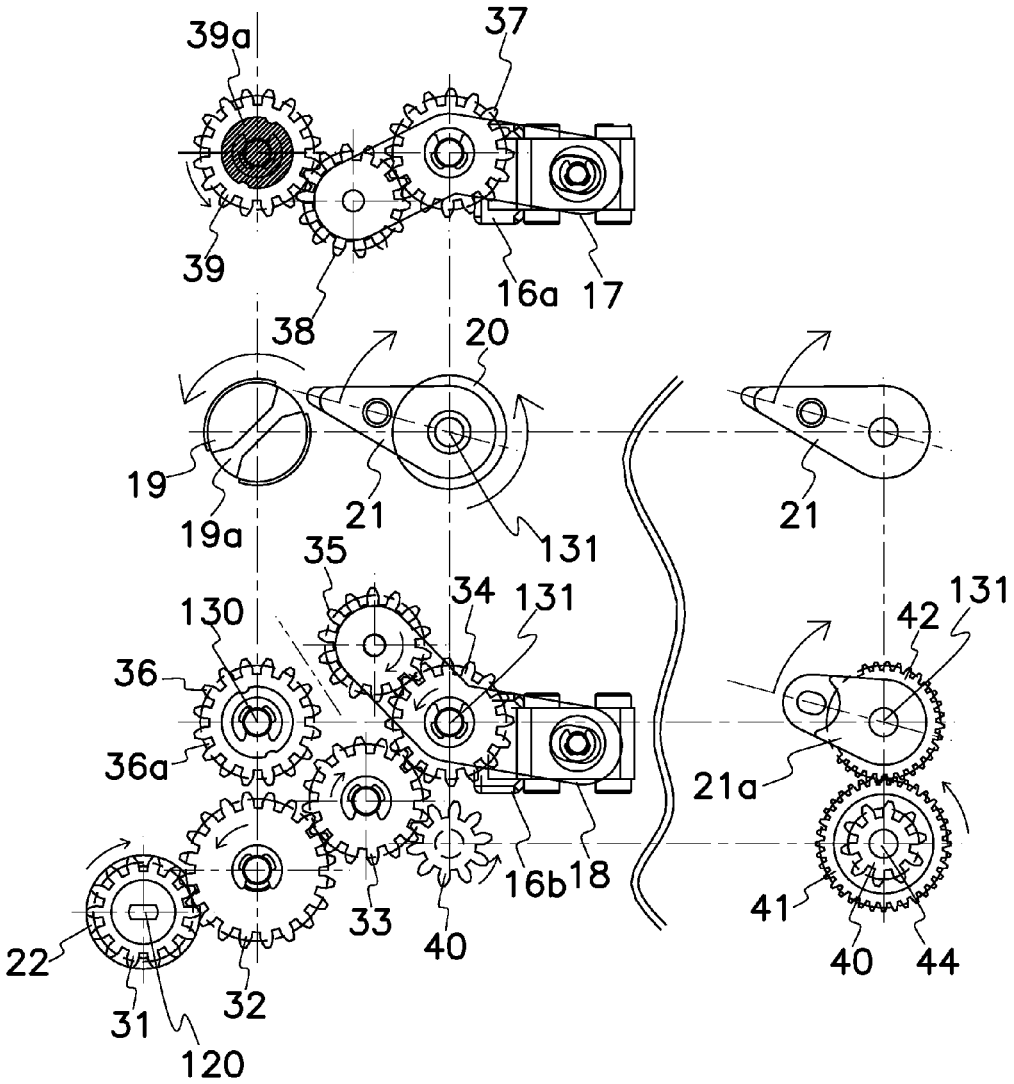
[FIG. 18] A side elevation view of the drive device for discharging a card from the storage while rotating the rotary guide in one direction.

To discharge card 70 from storage 51, when an operator pushes a clearing (liquidation) switch not shown, stack motor 22 shown in FIG. 18 rotates in the clockwise direction to further rotate gears 31, 32, 33 and 34 in turn respectively in the clockwise, counterclockwise, clockwise and counterclockwise directions to thereby rotate shaft 131 supporting gear 34 and stack roller 20 in the counterclockwise direction. Simultaneously, gear 37 secured on shaft 131 rotates in the counterclockwise direction to rotate first movable gear 38 meshed with gear 37 in the clockwise direction. Just then, as first and second holders 16*a* and 16*b* are in the lower position, second lever 18 swings downward to release engagement between second movable and guide gears 35 and 36 while first movable and guide gears 38 and 39 are engaged each other by rotation of first lever 17. Due to rotation of gear 37, first movable and guide gears 38 and 39 rotate respectively in the clockwise and counterclockwise directions. Torque of first guide gear 39 gives rotary guide 19 its counterclockwise rotation.

Figure 29:
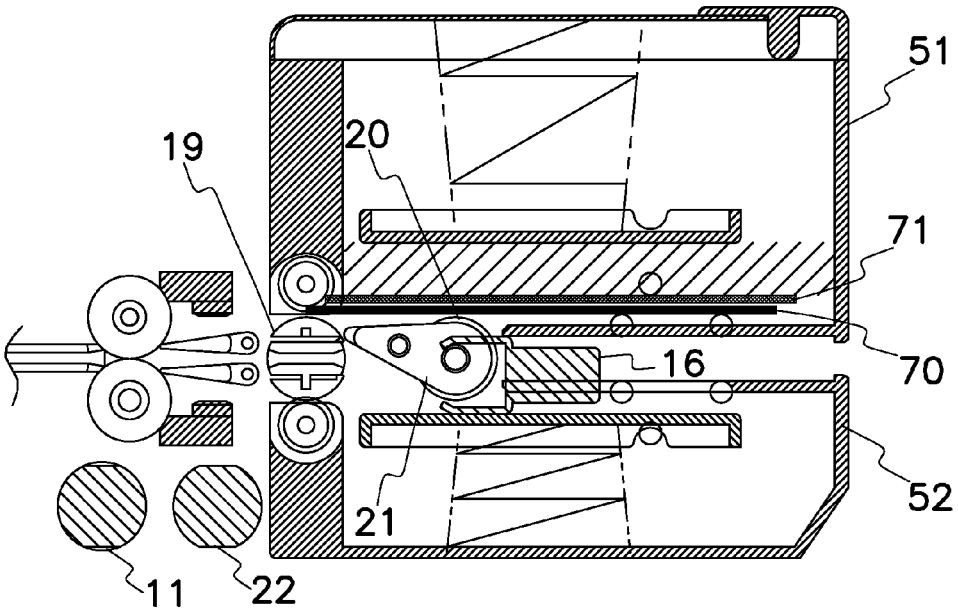
[FIG. 29] A sectional view of the stacker where a card is discharged from the storage.

Clockwise rotation of stack motor 22 provokes rotations of gears 31, 32, 33 and 40 in turn respectively in the clockwise, counterclockwise, clockwise and counterclockwise directions. Rotation of drive gear 40 is transmitted to follower gear 41 through frictional clutch FC. Deflector gear 42 meshed with follower gear 41 rotates in the clockwise direction, and rotation of follower gear 41 orients deflector 21 to the upswing shown in FIG. 29. Here, first and second holders 16*a* and 16*b* are in the lower position as shown in FIG. 29 to bring a lowermost card 70 in storage 51 into contact to stack roller 20. When stack roller 20 rotates in the counterclockwise direction, lowermost card 70 in contact to stack roller 20 is sent toward rotary guide 19. At this point, as deflector 21 is in the upswing, leading edge of card 70 is guided and moved along deflector 21 between outer surface of rotary guide 19 and upper guide roller 57 toward inlet 4 to further push upper flap 59*a* downward as shown in FIG. 30, and leading edge of card 70 is then grasped between posterior rollers 27*c* and 26 and sent toward inlet 4.

Figure 19:
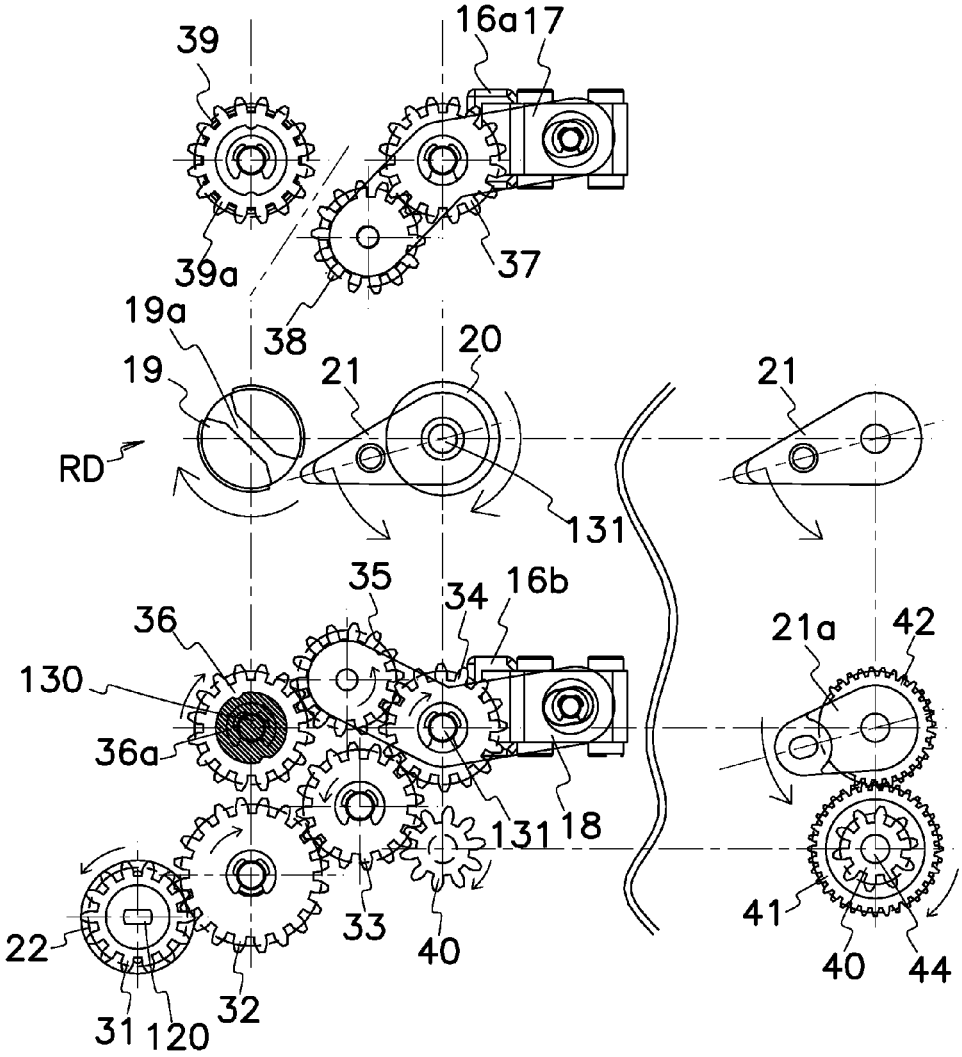
[FIG. 19] A side elevation view of the drive device for discharging a card from the collection device while rotating the rotary guide in the other direction.
Figure 20:
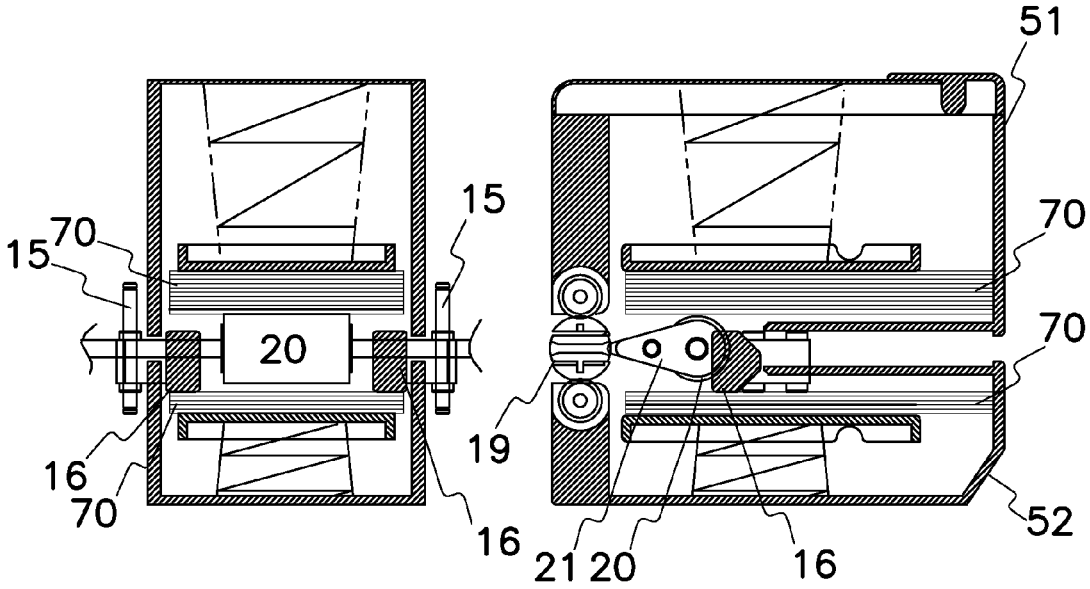
[FIG. 20] A sectional view of a stacker with holders moved to the lower position.
Figure 21:
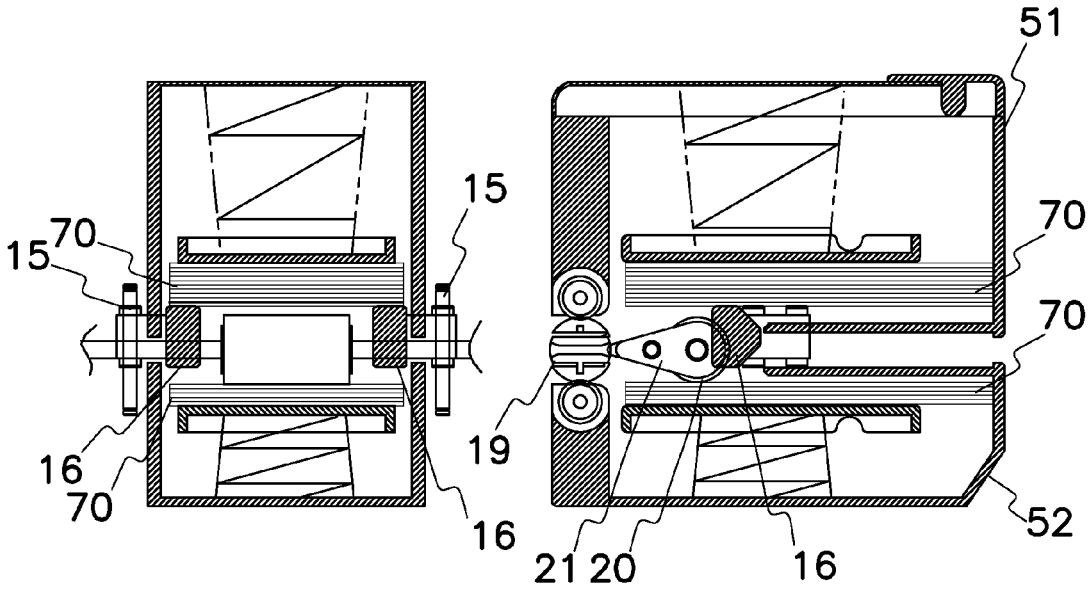
[FIG. 21] A sectional view of the stacker with the holders moved to the upper position.
Figure 22:
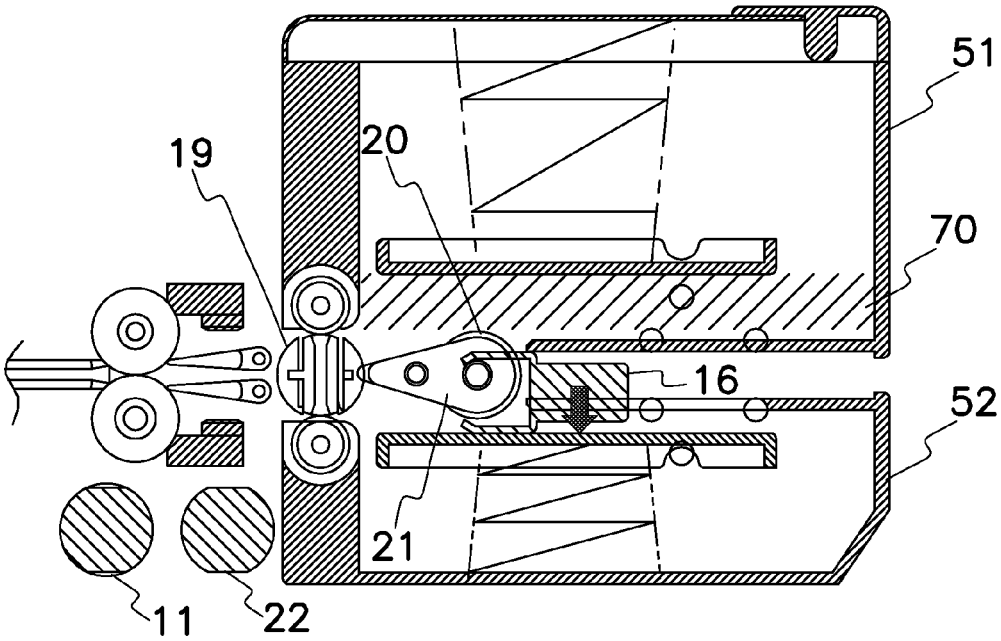
[FIG. 22] A sectional view of the stacker with the holders in the lower position.

When card 70 is discharged from collection device 52, first and second holders 16*a* and 16*b* not shown are in the upper position as shown in FIG. 19, and an upper surface of uppermost card 70 in collection device 52 is in contact to stack roller 20. When stack roller 20 is rotated in the clockwise direction, card 70 is sent toward rotary guide 17. At this point, as deflector 21 is in the downswing, leading edge of card 70 is grasped between outer surface of rotary guide 19 and lower guide roller 58. Clockwise rotation of rotary guide 19 feeds card 70 between rotary guide 19 and lower guide roller 58 toward inlet 4. Then, card 70 pushes lower flap 59*b* upward to be grasped between posterior rollers 27*c* and 26 and sent toward inlet 4.

Combined structure of stack and retention motors 22 and 11 can realize four operations, namely discharging card 70 from storage 51 (FIG. 16), stowing card 70 into collection device 52 (FIG. 17), stowing card 70 into storage 51 (FIG. 18) and discharging card 70 from collection device 52 (FIG. 19).

Figure 30:
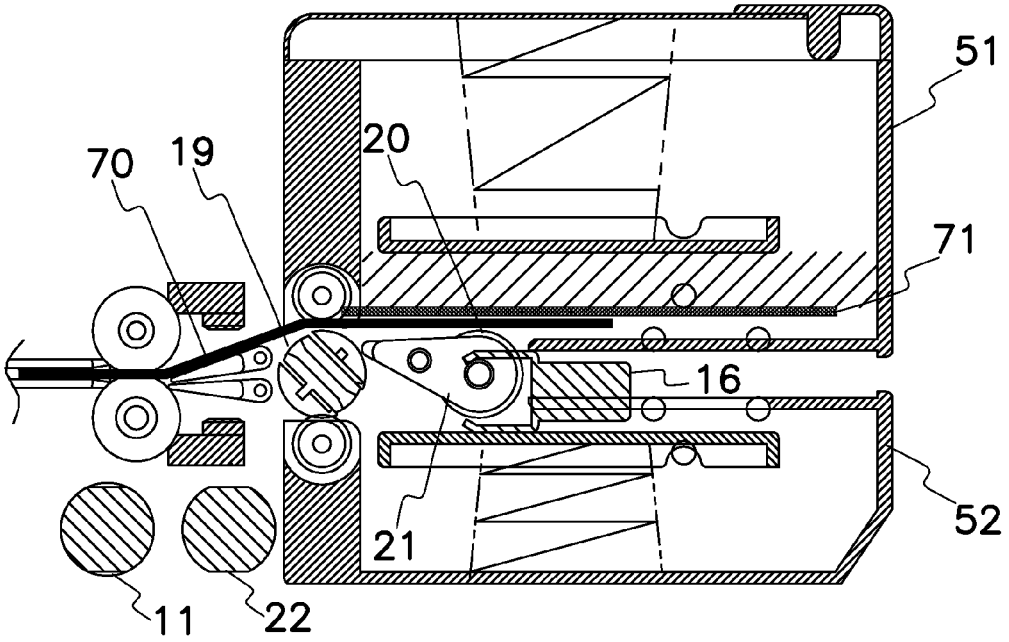
[FIG. 30] A sectional view of the stacker where a card is discharged from the storage during rotation of one of guides.
Figure 31:
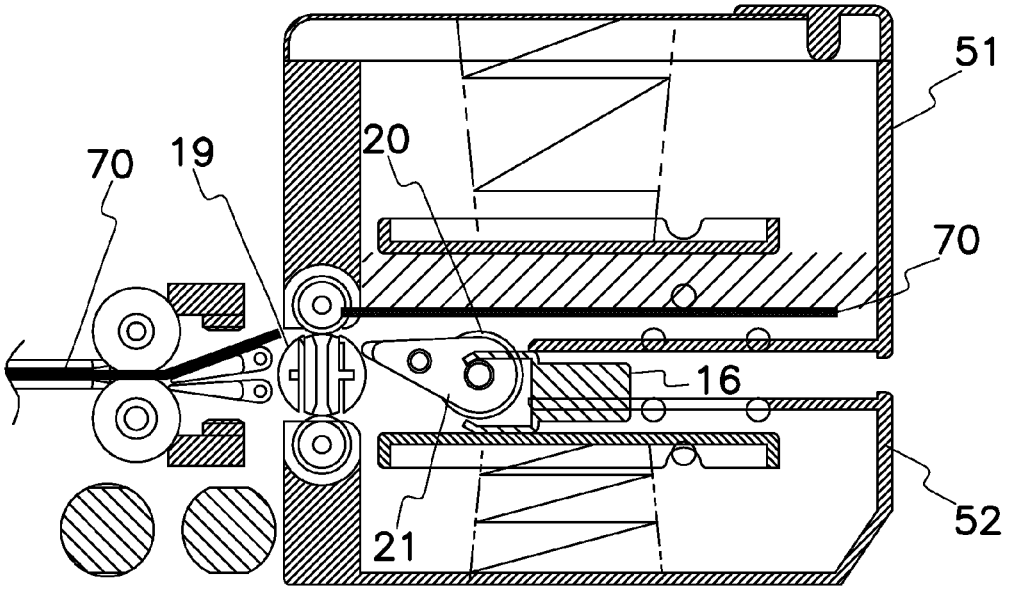
[FIG. 31] A sectional view of the stacker that bars discharge of a successive card following FIG. 30.
Figure 32:
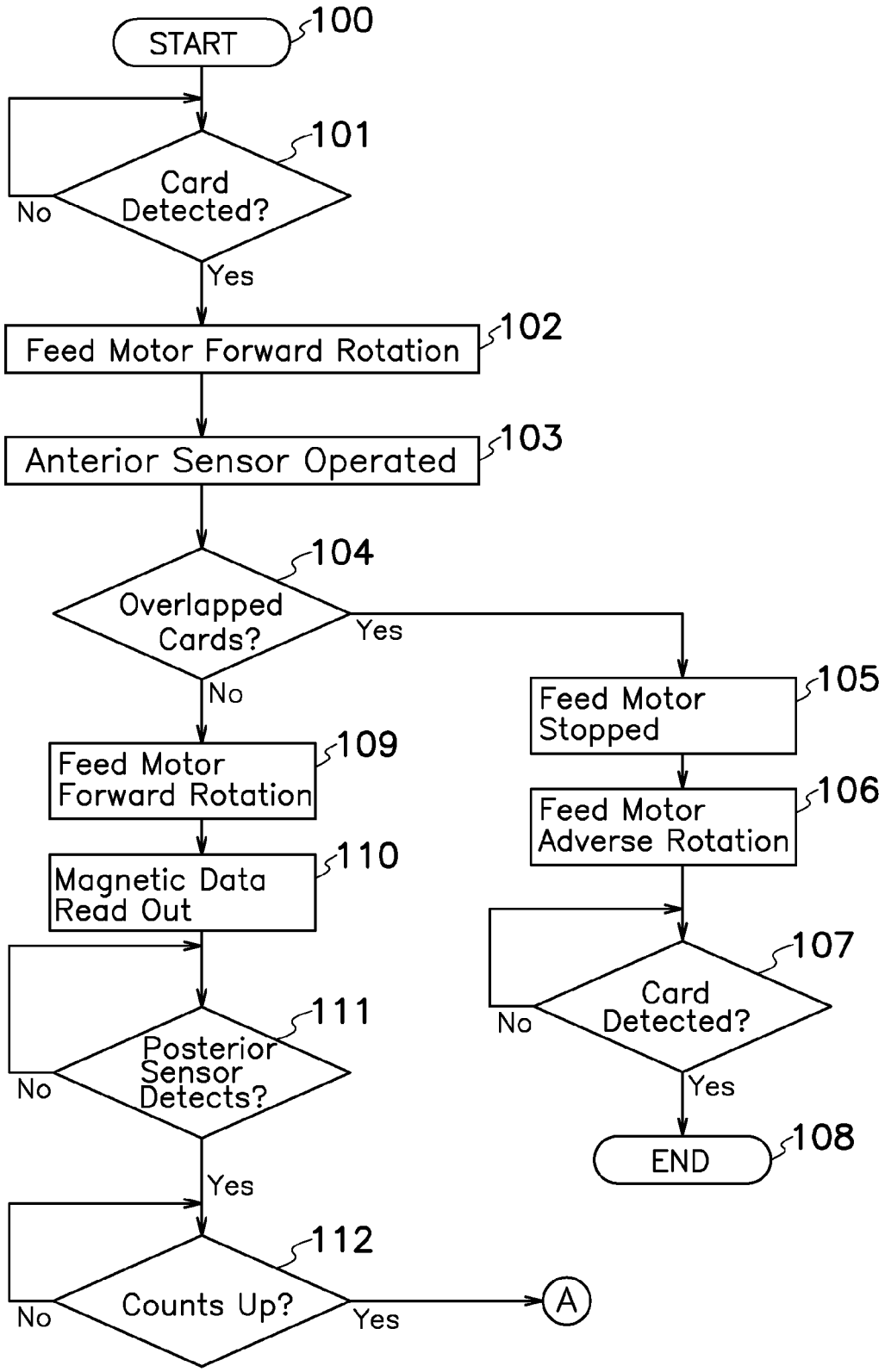
[FIG. 32] A first flow chart showing a first operational sequence of the card printing/stacking device according to the present invention.

FIG. 30 illustrates extraction of card 70 from storage 51. As shown in FIG. 16, when stack motor 22 rotates in the forward or counterclockwise direction in the lowered position of first and second holders 16*a* and 16*b* for releasing engagement between second movable and guide gears 35 and 36 and simultaneously for establishing engagement between first movable and guide gears 38 and 39, guide gear 39 is rotated in the counterclockwise direction through gears 31 to 38, and deflector gear 42 is rotated in the clockwise direction through gears 31 to 33, 40 and 41. This causes stack roller 20 to rotate in the counterclockwise direction to also rotate rotary guide 19 in the counterclockwise direction to thereby rotate deflector 21 to the upswing. During rotation of first guide gear 39, one-way clutch not shown in first guide gear 39 operates in the engaged condition to rotate rotary guide 19 secured to first guide gear 39 in the same direction.

FIG. 27 illustrates arrangement of card 70 into collection device 52. As shown in FIG. 17, stack motor 22 (also shown in FIG. 15) rotates in the clockwise direction, and when first and second holders 16*a* and 16*b* are in the upper position, second movable and guide gears 35 and 36 are engaged with each other, adversely, first movable and guide gears 38 and 39 are disengaged from each other. When gear 31 rotates in the clockwise direction, gears 32, 34, 36, 37, 40 and 41 rotate in the counterclockwise direction, and simultaneously, gears 33, 35, 38 and 42 rotate in the clockwise direction. Thus, stack roller 20 rotates in the counterclockwise direction, while rotary guide 19 is stopped, and deflector 21 swings upward. During rotation of gear 36, one-way clutch not shown provided in gear 36 yields slippage between gear 36 and rotary guide 19 to idle rotary guide 19 mounted on the common shaft as that of gear 36.

FIG. 24 illustrates arrangement of card 70 into storage 51. As shown in FIG. 18, stack motor 22 (also shown in FIG. 15) rotates in the counterclockwise direction, and when first and second holders 16*a* and 16*b* are in the lower position, second movable and guide gears 35 and 36 are disengaged from each other, adversely, first movable and guide gears 38 and 39 are engaged with each other. When gear 31 rotates in the counterclockwise direction, gears 32, 34, 35, 37, 39, 40 and 41 rotate in the clockwise direction, and simultaneously, gears 33, 38 and 42 rotate in the counterclockwise direction. Thus, stack roller 20 rotates in the clockwise direction, while rotary guide 19 is stopped, and deflector 21 swings downward. During rotation of gear 39, one-way clutch not shown provided in gear 39 yields slippage between gear 39 and rotary guide 19 to idle rotary guide 19 mounted on the common shaft as that of gear 39.

To issue card 70 from collection device 52, as shown in FIG. 19, stack motor 22 (also shown in FIG. 19) rotates in the counterclockwise direction, and when first and second holders 16*a* and 16*b* are in the upper position, second movable and guide gears 35 and 36 are engaged with each other, adversely, first and second movable and guide gears 38 and 39 are disengaged from each other. When gear 31 rotates in the counterclockwise direction, gears 32, 34, 36, 37, 40 and 41 rotate in the clockwise direction and gears 33, 35, 38 and 42 rotate in the counterclockwise direction. Thus, stack roller 20 rotates in the clockwise direction, while rotary guide 19 rotates in the clockwise direction to swing deflector 21 downward. During rotation of second guide gear 36, one-way clutch 36*a* in second guide gear 36 operates in the engaged condition to rotate rotary guide 19 secured to second guide gear 36 in the same direction.

Figure 44:
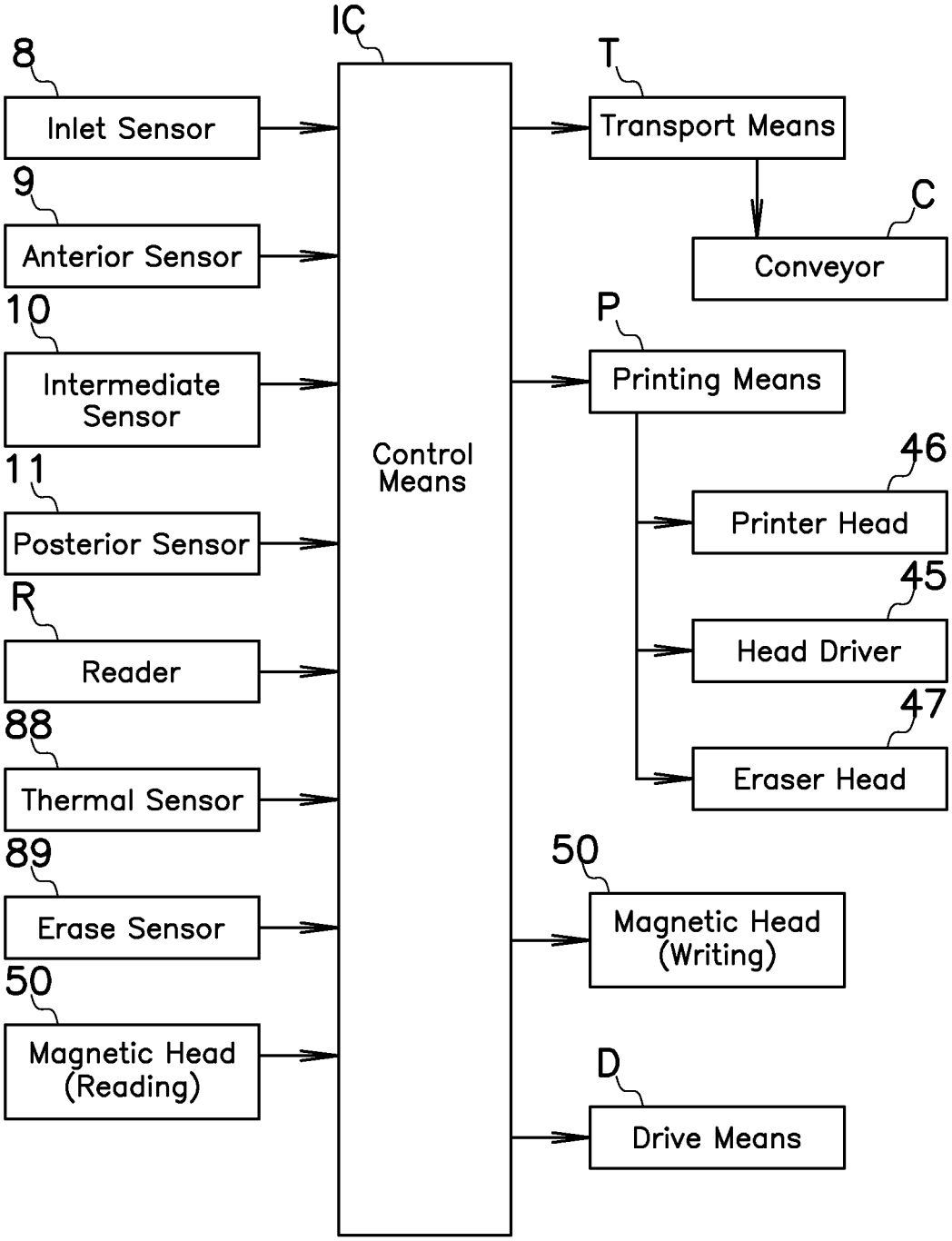
[FIG. 44] An electric circuit diagram showing an electric control system for use in the card printing/stacking device according to the present invention.

The card printer and card printing/stacking device according to the present invention comprise an electric configuration shown in FIG. 44. Control device IC may comprise a single microcomputer or a plurality of microcomputers, ICs or discrete circuits, and has input terminals connected to inlet sensor 8, anterior sensor 9, intermediate sensor 10, posterior sensor 23, reader R, thermal sensor 88, eraser sensor 89, head driver 45 and magnetic head 50 for magneto-electric reading. Control device IC also has output terminals connected to transporter T, printer P, magnetic head 50 for magneto-electric writing and driver D. Transporter T is connected to conveyor C, and printer P is connected to printer head 46, head driver 45 and eraser head 47.

Electric circuit shown in FIG. 44 of the card printer and card printing/stacking device is operated in accordance with operational sequences shown in FIGS. 32 to 42.

FIGS. 32 to 37 indicate processes for stowing card 70 inserted from inlet 4 into storage 51. Processing moves from START (Step 100) onto Step 101 where control device IC decides on whether or not it receives a detection signal from inlet sensor 8 indicative of detecting insertion of card 70 into inlet 4 in card printer 1. When control device 1 detects detection signal from inlet sensor 8, it provides feed motor 30 with drive signals that rotates feed motor 30 in the forward direction (Step 102) to transport card 70 along passageway 5. When anterior sensor 9 detects card 70, it produces a detection signal (Step 103). Then, in Step 104, control device IC receives detection signal from anterior sensor 9 and decides on whether or not card 70 is transported as a single sheet or as a plurality of overlapped sheets or as stuck cards in view of received detection signal (Step 104). When control device IC decides overlapped sheets, processing advances to Step 105 where it stops and reverses feed motor 30 (Step 106) to return card 70 to inlet 4. When inlet sensor 8 detects returned card 70 (Step 107), protocol goes on to Step 108 to finish a sequence of operational behaviors. In this state, an operator may pull out card 70 protruded from inlet 4 and remove it from card printer 1.

When control device IC considers card 70 as a single sheet without stuck cards in Step 104, protocol moves on to Step 109 where control device IC rotates feed motor 30 in the forward direction to transport card 70 to the rear of passageway 5. Magnetic head 50 magneto-electrically reads out bar codes or other codes magnetically recorded on moving card 70 to produce readout signals to control device IC (Step 110) that then considers readout content of card 70 in view of read card 70. In lieu of magnetically recorded bar codes, an optical sensor may be used to photo-electrically read out bar codes recorded on card 70 to produce readout signals to control device IC. Thereafter, proceeding goes on to Step 111 where control device IC decides on whether or not posterior sensor 23 detects passage of card 70. If this is affirmative, posterior sensor 23 provides control device IC with a detection signal to advance the process to Step 112 where control device IC decides on whether or not a rotary encoder connected to feed motor 30 counts a predetermined number of pulses.

Figure 33:
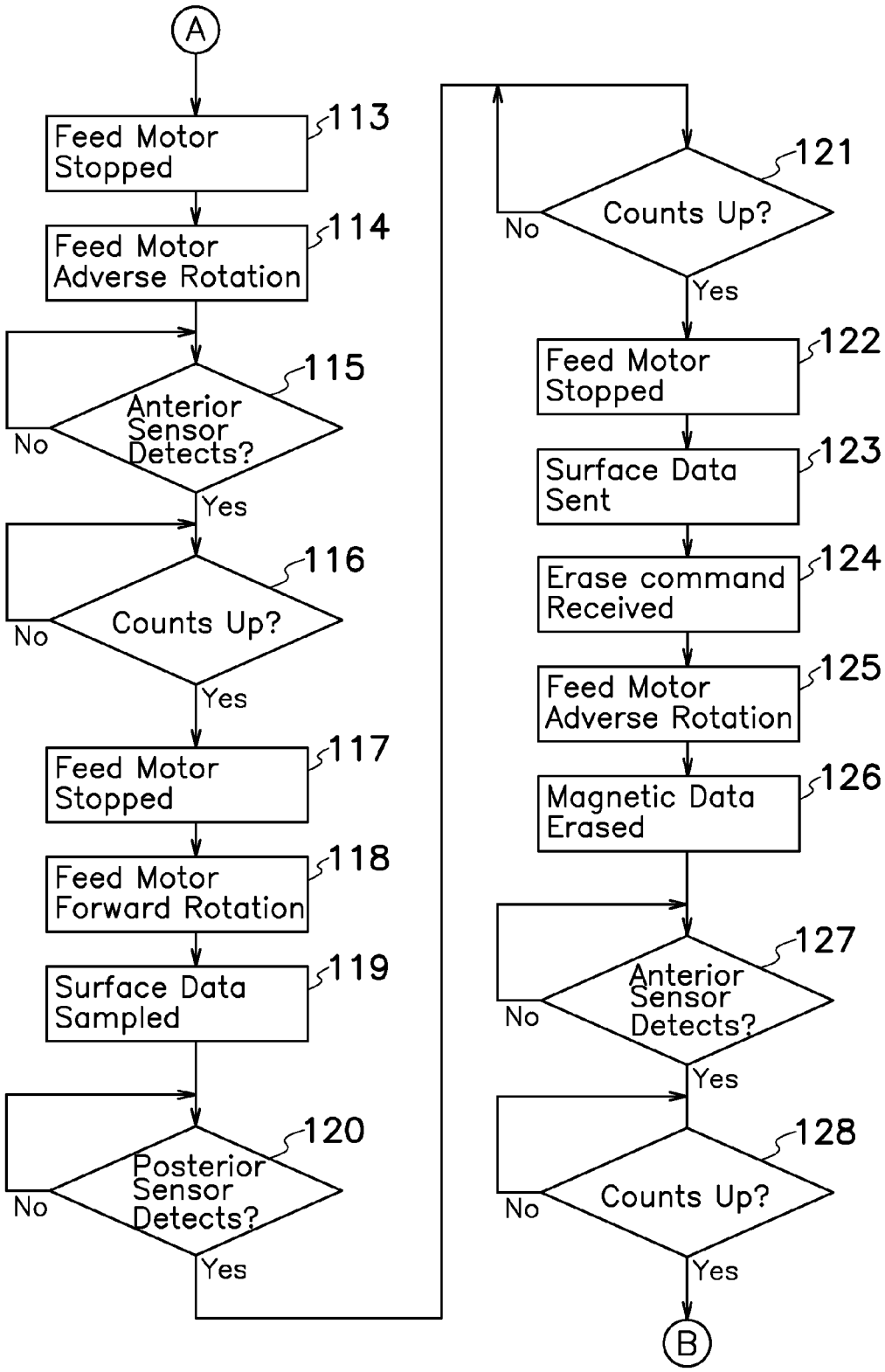
[FIG. 33] A second flow chart showing a second operational sequence of the card printing/stacking device according to the present invention.
Figure 34:
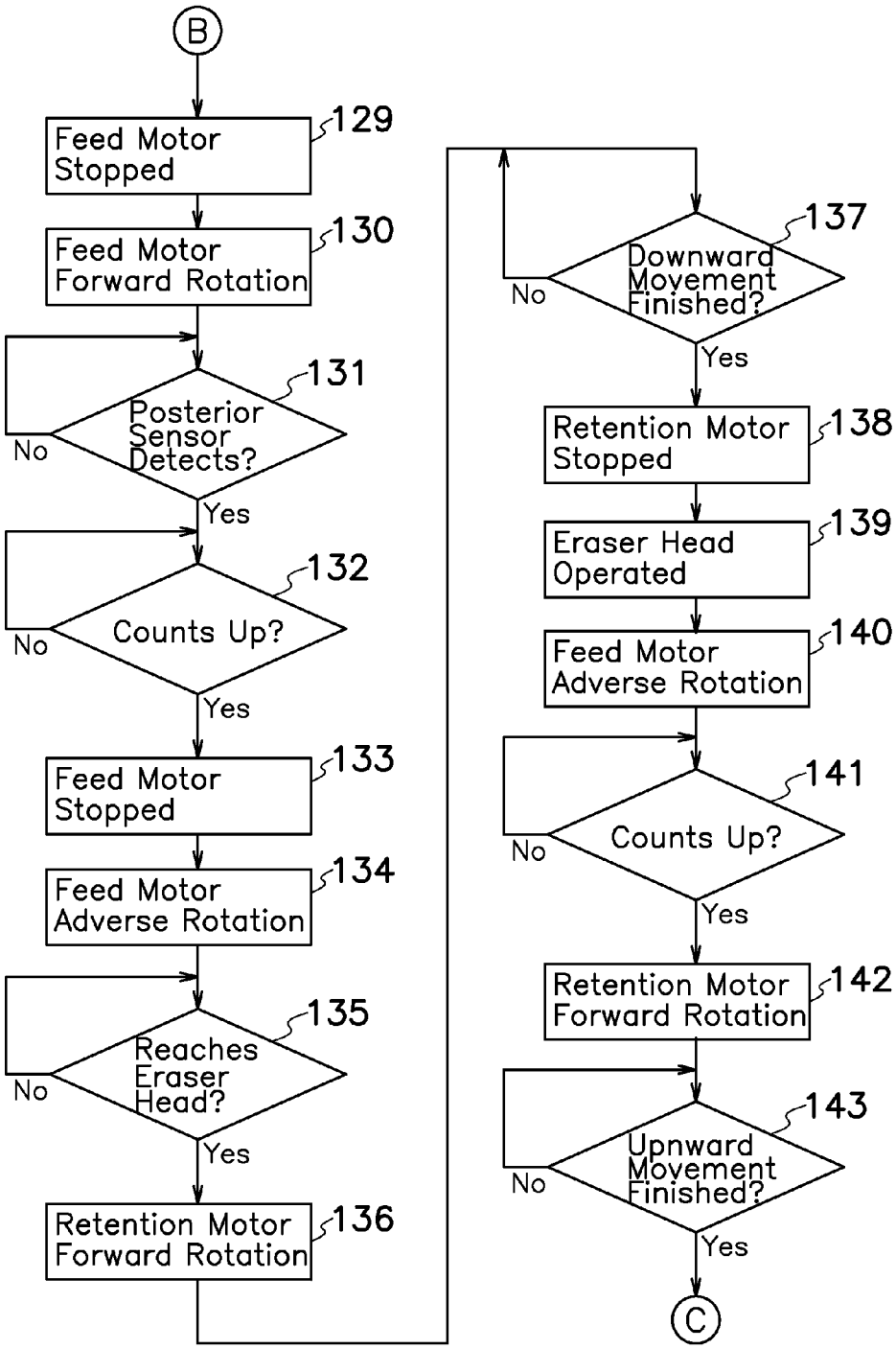
[FIG. 34] A third flow chart showing a third operational sequence of the card printing/stacking device according to the present invention.
Figure 35:
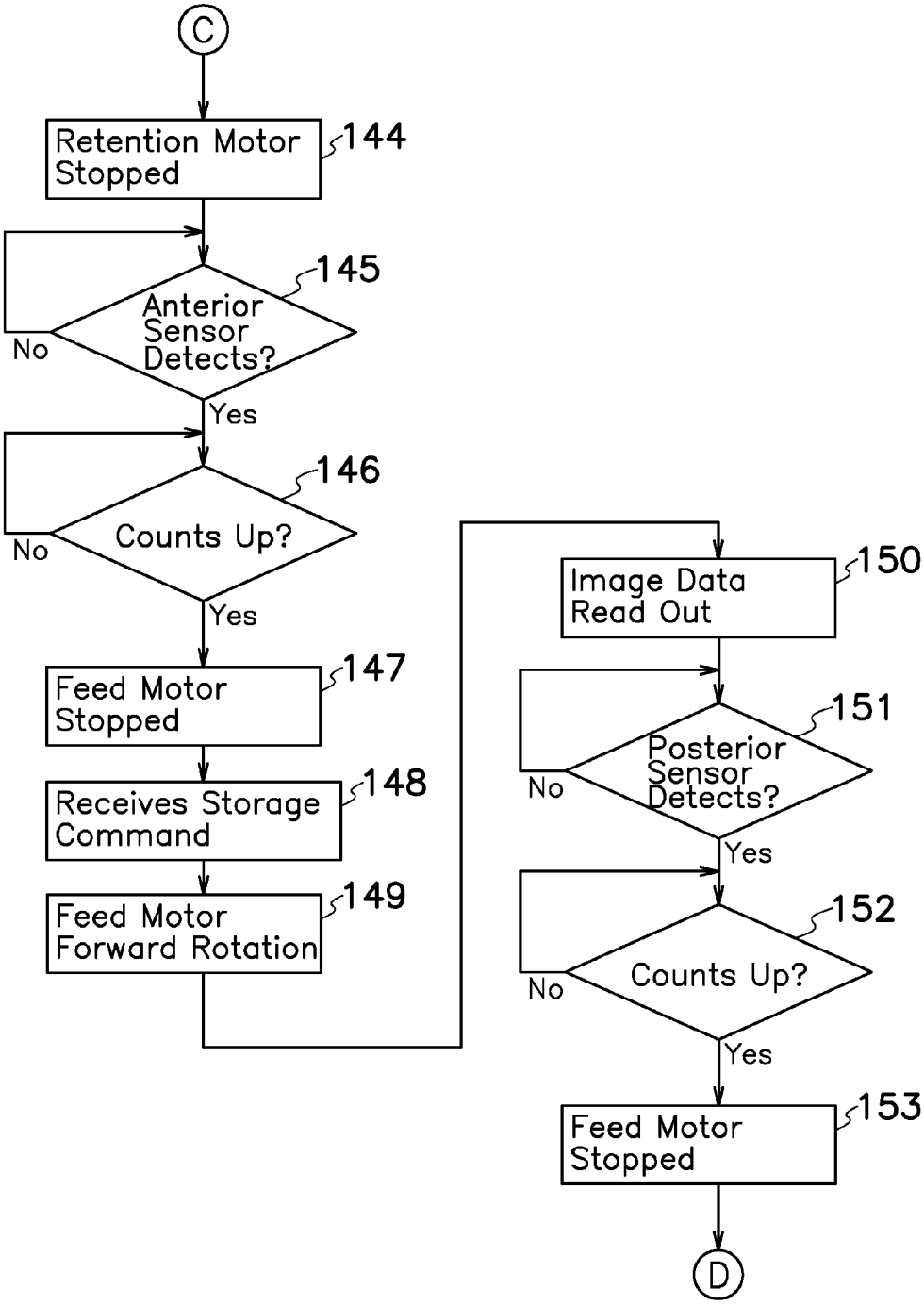
[FIG. 35] A fourth flow chart showing a fourth operational sequence of the card printing/stacking device according to the present invention.
Figure 36:
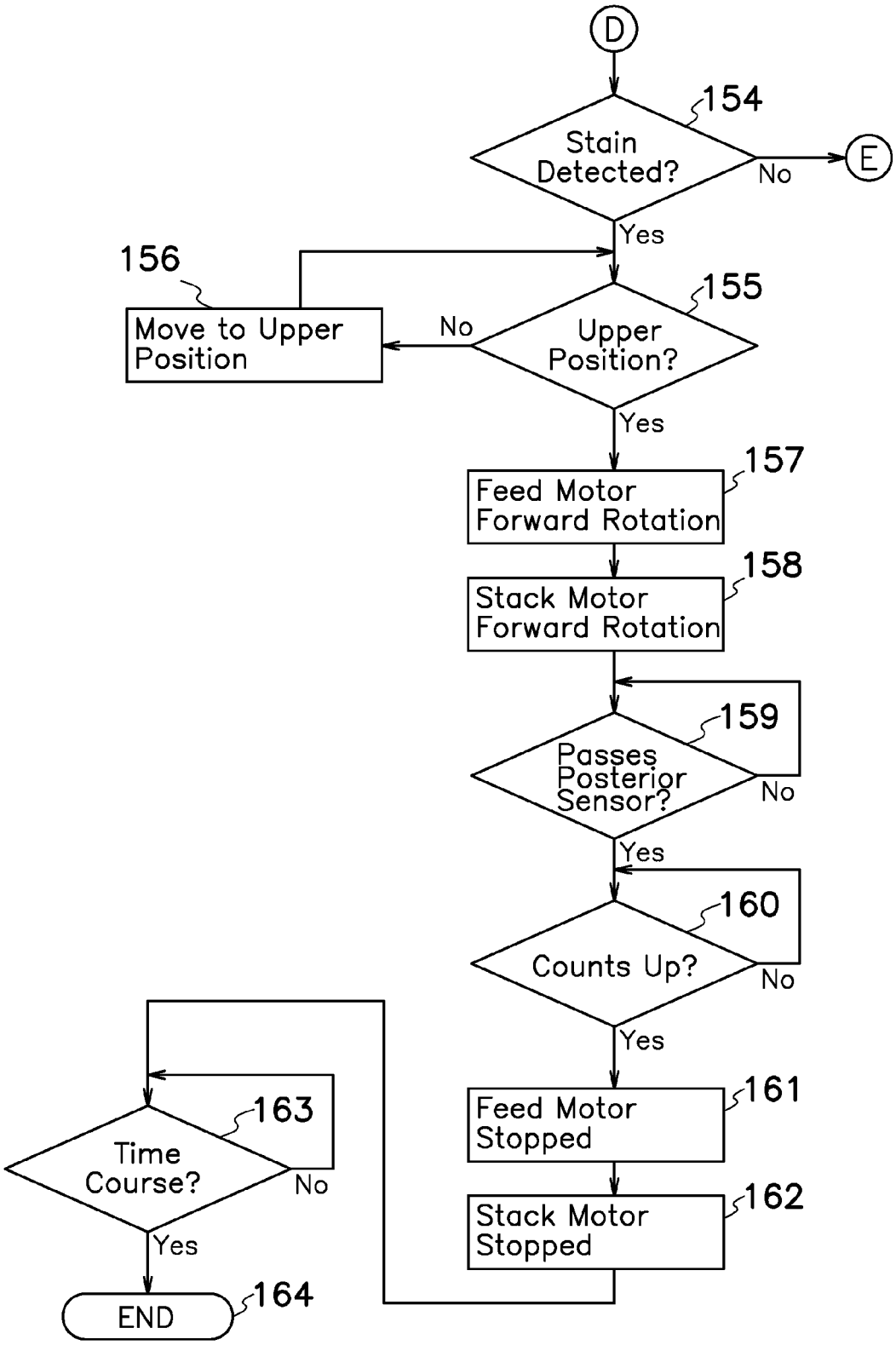
[FIG. 36] A fifth flow chart showing a fifth operational sequence of the card printing/stacking device according to the present invention.
Figure 37:
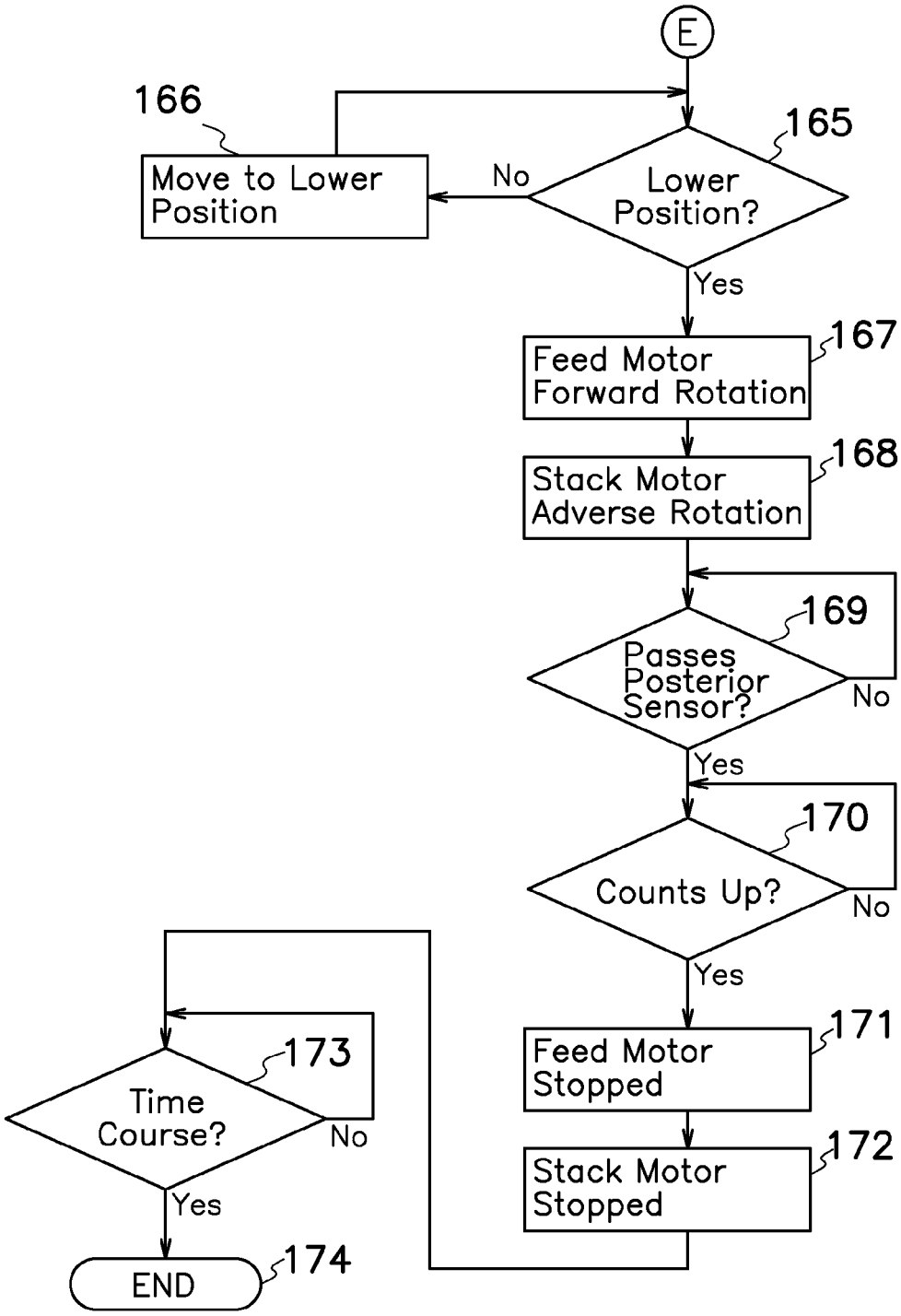
[FIG. 37] A sixth flow chart showing a sixth operational sequence of the card printing/stacking device according to the present invention.
Figure 38:
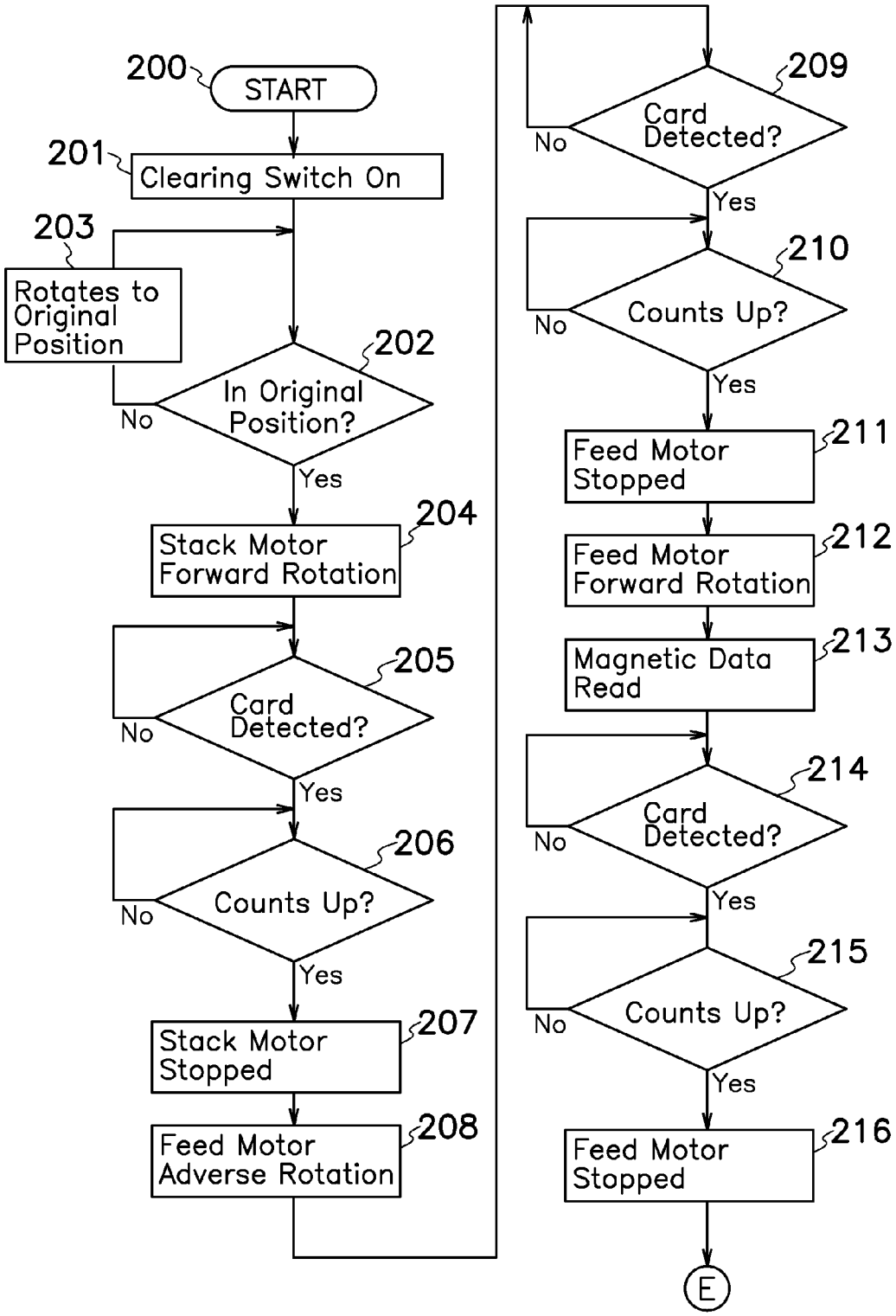
[FIG. 38] A seventh flow chart showing a seventh operational sequence of the card printing/stacking device according to the present invention.
Figure 39:
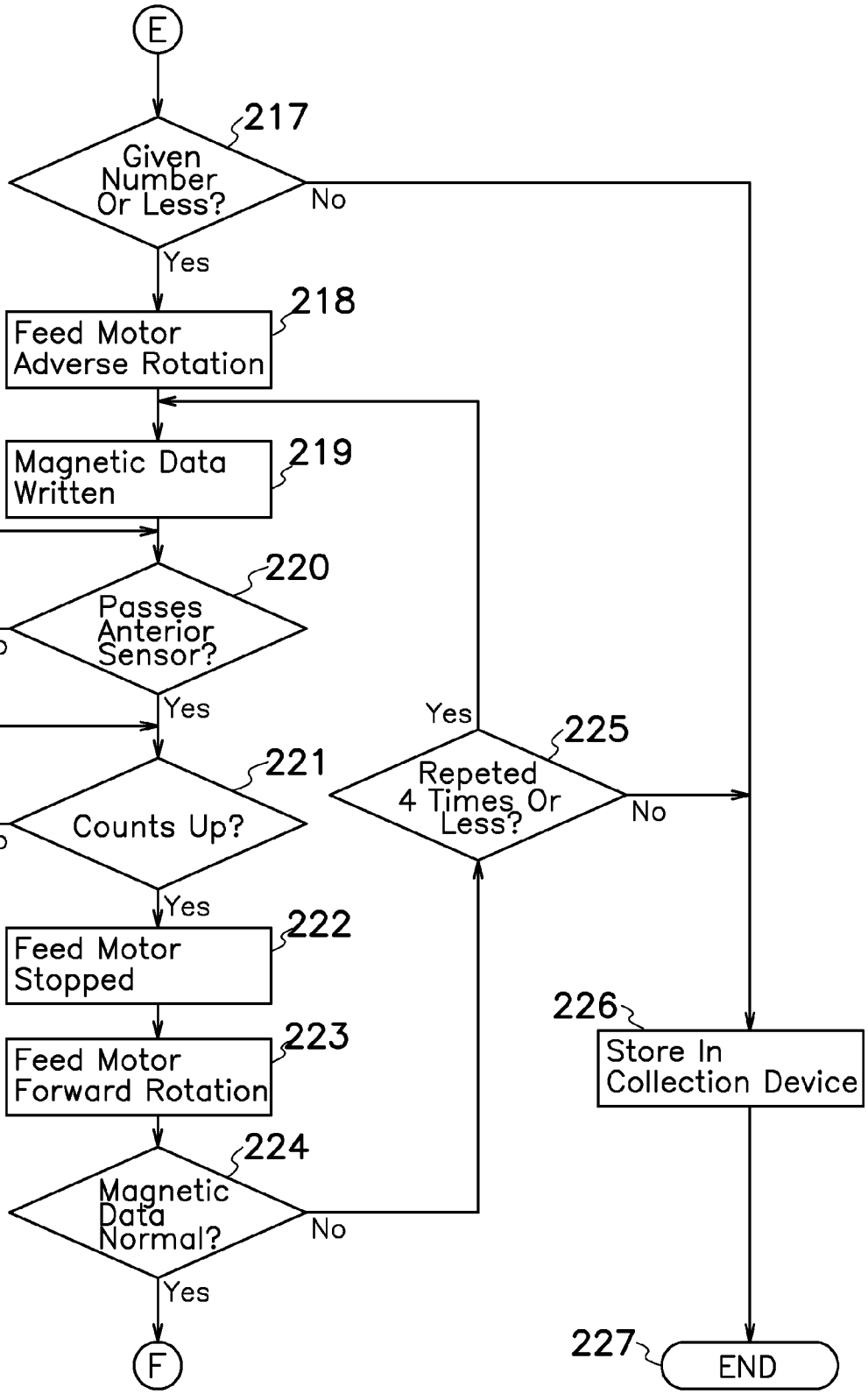
[FIG. 39] An eighth flow chart showing an eighth operational sequence of the card printing/stacking device according to the present invention.
Figure 40:
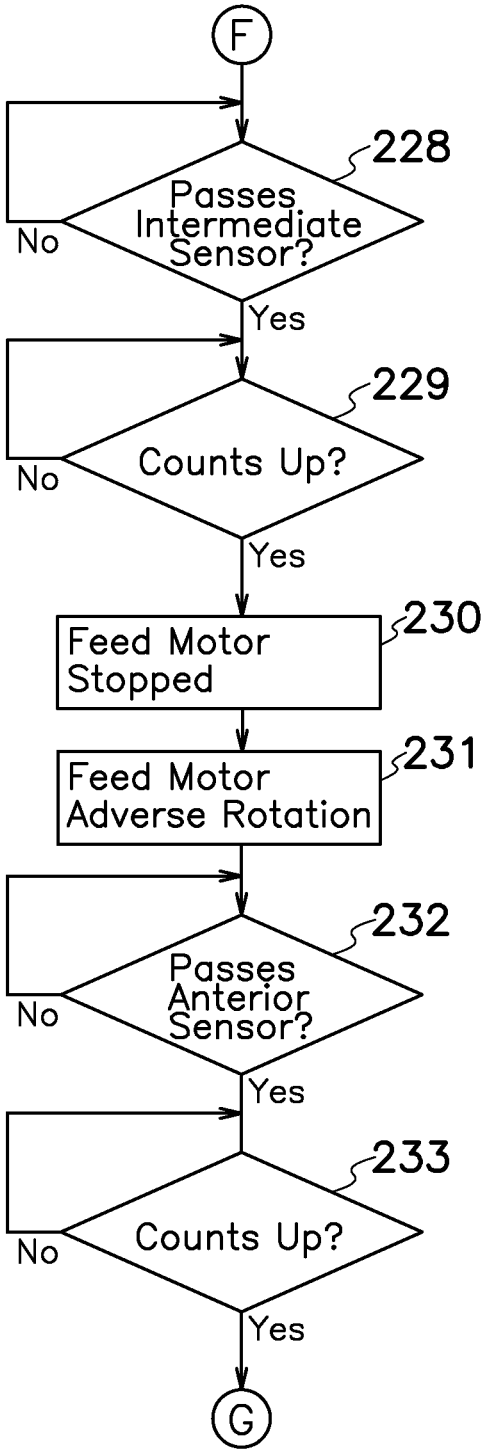
[FIG. 40] A ninth flow chart showing a ninth operational sequence of the card printing/stacking device according to the present invention.
Figure 41:
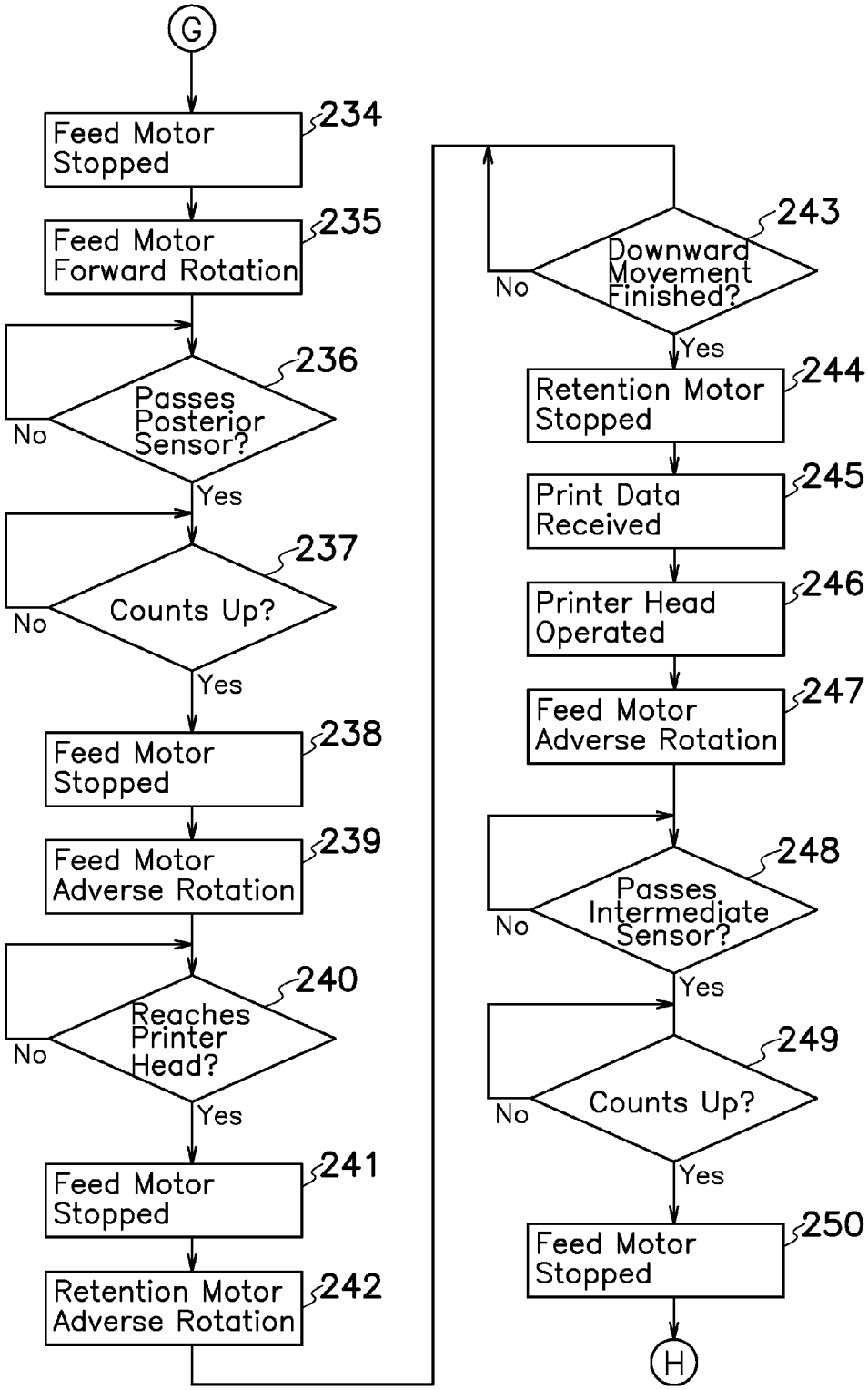
[FIG. 41] A tenth flow chart showing a tenth operational sequence of the card printing/stacking device according to the present invention.
Figure 42:
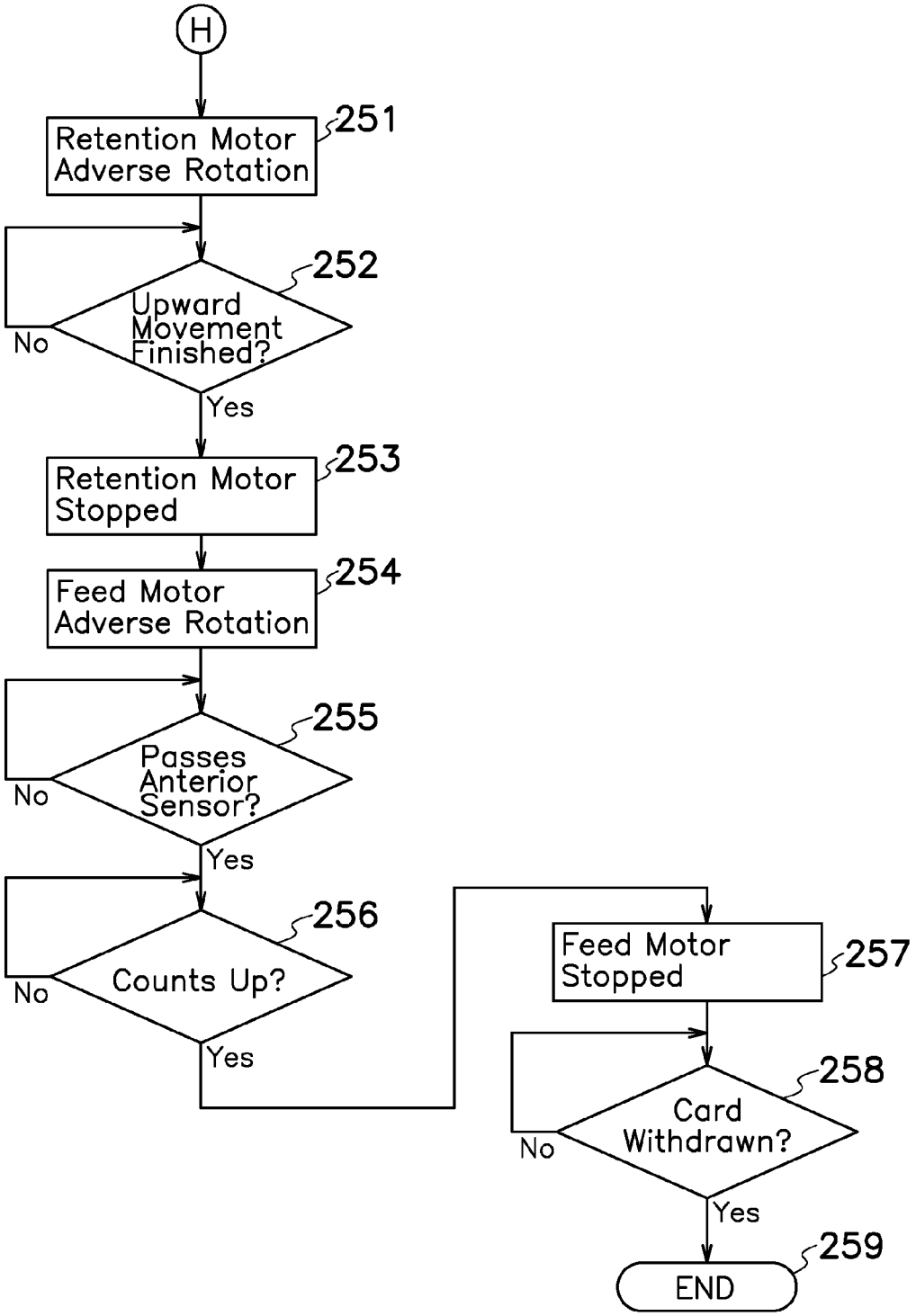
[FIG. 42] An eleventh flow chart showing an eleventh operational sequence of the card printing/stacking device according to the present invention.

When rotary encoder counts a predetermined number of pulses in Step 113 of FIG. 33, control device IC temporarily stops and adversely rotate feed motor 30 (Step 114). Then, control device IC decides on whether or not anterior sensor 9 detects passage of card 70 in Step 115, and if detects this, anterior sensor 9 forwards a detection signal to control device IC. In Step 116, control device IC makes a decision on whether or not rotary encoder counts a predetermined number of pulses, and if counts this, control device IC temporarily stops feed motor 30 in Step 117 and restarts it in the forward direction to cause image sensors 48 and 49 to photo-electrically sample data recorded on a surface of card 70 (Step 119). Then, processing moves on to Step 120 where control device IC decides on whether or not posterior sensor 23 detects passage of card 70 to produce a detection signal to control device IC. If this is affirmative in Step 120, after receiving detection signal from posterior sensor 23, control device IC decides on whether or not rotary encoder counts a predetermined number of pulses (Step 121). When rotary encoder counts pulses of that number, control device IC stops feed motor 30 in Step 122, and image sensors 48 and 49 forward sampled data to control device IC in Step 123. Then, in Step 124, printing means P receives an erase command from control device IC that rotates feed motor 30 in the adverse direction in Step 125 to cause magnetic head 50 to erase data magnetically recorded on card 70 in Step 126. Subsequently, control device IC decides on whether or not anterior sensor 9 detects passage of card 70 in Step 127, and upon the detection, control device IC decides in Step 128 on whether or not rotary encoder counts a predetermined number of pulses. If counts that number, control device IC temporarily stops feed motor 30 in Step 129 and restarts it to rotate in the forward direction in Step 130.

Next, control device IC decides on whether or not posterior sensor 23 detects passage of card 70 in Step 131, and if detects it, control device IC further decides on whether or not rotary encoder counts a predetermined number of pulses in Step 132. If counts that, control device IC stops feed motor 30 in Step 133 and rotates it in the adverse direction in Step 134, and then, control device IC decides on whether or not card 70 reaches eraser head 47 in Step 135. If card 70 reaches there, control device IC rotates retention motor 11 in the forward direction in Step 136, and decides through a detection sensor not shown in Step 137 on whether or not eraser head 47 completes its downward movement. When the detection sensor detects downward movement of eraser head 47 to produce a detection signal to control device IC, it stops retention motor 11 in Step 138. Then, it operates eraser head 47 in Step 139, and after rotates feed motor 30 in the adverse direction in Step 140, it decides on whether or not rotary encoder counts a predetermined number of pulses in Step 141 to convey card 70 a given distance. When rotary encoder counts that number of pulses to yield a detection pulse to control device IC, it rotates retention motor 11 in the forward direction in Step 142 and decides in Step 143 by a detection signal generated by a position sensor not shown on whether or not eraser head 47 completes its upward movement.

When position sensor detects upward movement of eraser head 47 in Step 143 to emit a detection signal to control device IC, it stops retention motor 11 in Step 144 and decides in Step 145 on whether or not anterior sensor 9 detects card 70. When anterior sensor 9 detects card 70, control device IC decides in Step 146 on whether or not rotary encoder counts a predetermined number of pulses. When counts that, control device IC stops feed motor 30 in Step 147 and decides in Step 148 on whether or not image sensors 48 and 49 receive storage command from control device IC. Subsequently, control device IC rotates feed motor 30 in the forward direction in Step 149; image sensors 48 and 49 read out image data from card 70 in Step 150; and control device IC decides from detection signals from anterior sensor 23 in Step 151 on whether or not card 70 passes posterior sensor 23. When card 70 passes posterior sensor 23, control device IC decides in Step 152 on whether or not rotary encoder counts a predetermined number of pulses, and when counts that, control device IC stops feed motor 30 in Step 153.

Then, in Step 154, control device IC decides in view of detected signals from image sensors 48 and 49 on whether or not card 70 has any stain, and if it has no stain, processing jumps to Step 165, but if it has a stain, processing moves on to Step 155 where control device IC decides on whether or not first and second holders 16*a* and 16*b* are in the upper position. When first and second holders 16*a* and 16*b* are not in the upper position in Step 155, control device IC operates retention motor 11 to move first and second holders 16*a* and 16*b* to the upper position in Step 156. If first and second holders 16*a* and 16*b* are in the upper position in Step 155, control device IC drives feed motor 30 for its forward rotation in Step 157 and also drives stack motor 22 for its forward rotation in Step 158, and afterward, decides on whether or not posterior sensor 23 detects passage of card 70 in Step 159. When control device IC receives detection signal indicative of passage of card 70 from posterior sensor 23, it then decides in Step 160 on whether or not rotary encoder counts a predetermined number of pulses. When rotary encoder counts that number, control device IC stops feed motor 30 (Step 161) and also stops stack motor 22 (Step 162). Subsequently, when control device IC detects clock signals from built-in timer indicative of course of a given time in Step 163, the operational sequence is finished (Step 164).

If there is found no stain on card 70 in Step 154, sequential command goes on to Step 165 where control device IC decides on whether or not first and second holders 16*a* and 16*b* are in the lower position. Unless holders 16*a* and 16*b* are in the lower position, control device IC drives retention motor 11 to move holders 16*a* and 16*b* to the lower position in Step 166. If holders 16*a* and 16*b* are in the lower position in Step 165, control device IC drives feed motor 30 for its forward rotation in Step 167 and simultaneously drives stack motor 22 for its reverse rotation in Step 168 to decide on whether or not posterior sensor 23 detects passage of card 70 in Step 169. If card 70 passes posterior sensor 23 in Step 169, control device IC decides on whether or not rotary encoder counts a predetermined number of pulses, and if counts that, control device IC stops feed motor 30 in Step 171 and also stops stack motor 22 in Step 172. Then, when control device IC detects clock signals from built-in timer indicative of course of a given time in Step 173, a series of behavior processes are finished (Step 174).

FIGS. 38 to 42 describe processes for issuing card 70 retained in storage 51 into inlet 4. Processing advances from Step 200 to 201 where an operator pushes clearing switch to move on to Step 202 where control device IC decides in view of output signals from a situs sensor not shown connected to control device IC on whether or not rotary guide 19 is in the original position. Unless rotary guide 19 is in the original position, control device IC drives stack motor 22 to rotate rotary guide 19 to the original position (Step 203). If rotary guide 19 is in the original position in Step 202, control device IC drives stack motor 22 for its forward rotation, moving on to Step 205 where control device IC decides on whether or not posterior sensor 23 detects card 70; when posterior sensor 23 detects it, protocol goes on to Step 206 where control device IC decides on whether or not rotary encoder counts a predetermined number of pulses. Once the time is up, control device IC stops stack motor 22 in Step 207 and drives feed motor 30 for its reverse rotation. Moreover, control device IC checks on whether or not anterior sensor 9 detects passage of card 70 in Step 209, and if detects passage of card 70, control device IC decides in Step 210 on whether or not rotary encoder counts a predetermined number of pulses. Once rotary encoder counts that, control device IC stops feed motor 30 in Step 211 and drives it for its forward rotation and causes magnetic head 50 to read out magnetic data in Step 213. Then, control device IC decides in Step 214 on whether or not intermediate sensor 10 detects passage of card 70, and when confirms passage of card 70 through intermediate sensor 10 emitting a detection signal to control device IC, it judges in Step 215 on whether or not rotary encoder counts a predetermined number of pulses. When rotary encoder counts that, control device IC stops feed motor 30 in Step 216, and checks in Step 217 on whether or not magnetic counter counts pulses equal to a predetermined number or less.

With counted pulses over a predetermined number by magnetic counter in Step 217, processing goes on to Step 226 where control device IC causes card 70 to be stowed into collection device 52 to then finish a series of behavior processes (Step 227). With counted pulses at the predetermined number or less in Step 217, control device IC drives feed motor 30 for its adverse rotation in Step 218 to write magnetic data on card 70 in Step 219. Further, control device IC decides in Step 220 on whether or not anterior sensor 9 detects passage of card 70, and when detects that, decides in Step 221 on whether or not rotary encoder counts a predetermined number of pulses. Upon counting that, control device IC stops feed motor 30 in Step 222 and again drives it for forward rotation, and then it decides in Step 224 on whether or not written magnetic data is normal. When magnetic data is not normal in Step 224, protocol moves on to Step 225 where control device IC decides on whether or not writing operation is repeated four times or less. If writing operation is retried four times or less, processing returns to Step 219, and if writing operation is repeated over four times, processing goes on to Step 226. If magnetic data is normal in Step 224, processing moves on to Step 228.

In Step 228, control device IC decides on whether or not intermediate sensor 10 detects passage of card 70. When intermediate sensor 10 detects passage of card 70 to produce a detection signal to control device IC, processing moves on to Step 229 where it decides on whether or not rotary encoder counts a predetermined number of pulses. Upon counting that, control device IC temporarily stops feed motor 30 in Step 230 and drives it for its adverse rotation in Step 231. Also, control device IC decides in Step 232 on whether or not anterior sensor 9 detects passage of card 70, and once detecting it, control device IC decides in Step 233 on whether or not rotary encoder counts a predetermined number of pulses. Upon counting that, control device IC temporarily stops feed motor 30 and then drives it for its forward rotation.

Afterward, control device IC decides in Step 236 on whether or not posterior sensor 23 detects passage of card 70, and upon detecting it, control device IC decides in Step 237 on whether or not rotary encoder counts a predetermined number of pulses. Upon counting it, control device IC temporarily stops feed motor 30 in Step 238 and then drives it for its adverse rotation. Moreover, control device IC decides in Step 240 on whether or not card 70 reaches printer head 46, and upon the arrival to printer head 46, control device IC stops feed motor 30 in Step 241 and reversely rotates retention motor 11 in Step 242. Then, control device IC decides in Step 243 on whether or not downward movement of printer head 46 is completed; upon its completion, procedure advances to Step 244 where retention motor 11 is stopped; in Step 245, printer P received print data; and in Step 246, control device IC causes printer head 46 to operate. In Step 247, control device IC adversely rotates feed motor 30 and decides in Step 248 on whether or not intermediate sensor 10 detects passage of card 70. Then, control device IC decides in Step 249 on whether or not rotary encoder counts a predetermined number of pulses, and when counts that, stops feed motor 30 in Step 250.

Moreover, protocol goes on to Step 251 where control device IC reversely rotates retention motor 11 and decides in Step 252 on whether or not upward movement of printer head 46 is completed. Upon completion of the upward movement, control device IC stops retention motor 11 in Step 253 and adversely rotates feed motor 30 in Step 254. Then, control device IC decides in Step 255 on whether or not anterior sensor 9 detects passage of card 70, and when anterior sensor 9 forwards a signal of detecting card 70 to control device IC, processing moves on to Step 256 where control device judges on whether or not rotary encoder counts a predetermined number of pulses. Upon counting that number of pulses, control device IC stops feed motor 30 in Step 257 and decides in Step 258 on whether or not card 70 is withdrawn from inlet 4. When inlet sensor 8 detects withdrawal of card 70 from inlet 4 to produce a detection signal to control device IC, a series of behavior processes are finished (Step 259).

Embodiments of the card printer and card printing/stacking device according to the present invention have the following functions and effects:

(1) Cards 70 inappropriate for use may be recalled into collection device 52 to prevent issuance of inappropriate cards for improvement in service quality.

(2) Deflector 21 of simplified structure in stacker 7 may be used to divide cards into storage 51 and collection device 52 for individual storage to downsize the whole device.

(3) Rotary guide 19 in stacker 7 may be used to certainly discharge cards 70 from stacker 7.

(4) Detachably attached to the card printer is stacker 7 that is easy to restock card 70 therein and remove card 70 therefrom.

(5) Mounted in transport means T is magnetic head 50 capable of writing and reading magnetic information on card 70 to easily maintain information on number of use.

(6) Image sensors 48 and 49 along passageway 5 may optically detect image data on card 70 to pick out graffiti on card 70.

Embodiments of the present invention may be modified in various ways. For example, without providing a pair of image sensors 48 and 49 on the opposite sides of passageway 5, a single image sensor 48 or 49 may be used. An integral head of printing-erasing may be used instead of printer head 46 and eraser head 47 separately shown.

Control device IC may be connected to a control equipment or an external control device such as computer in a gaming machine, a currency validator or a bending machine to write information on card 70 or erase information from card 70 when control device IC receives writing or erasing instructions from external control device. The description sets forth an example of using a pair of first and second holders 16*a* and 16*b*, however, a single holder 16 may be used.

INDUSTRIAL APPLICABILITY

This invention is applicable to any system for rewritably printing or erasing information on cards for use in recreation machines such as gaming machines or laborsaving machines such as bill validators or vending machines.

The invention claimed is:

1. A card printing/stacking device comprising:

a card printer having a passageway with an inlet formed at one end of the passageway, and a stacker arranged at the other end of the passageway for stowing a card transported along the passageway, wherein the card printer comprises:

transport means for transporting the card along the passageway, reading means provided in the vicinity of the passageway for reading out information recorded on a surface of the card transported along the passageway, printing means for recording information on and erasing information from the surface of the card, and control means electrically connected to the transport means, reading means and printing means for determining whether to record information on or to erase information from the surface of the card and for controlling operation of the transport means and printing means depending on the information forwarded from the reading means, the stacker comprises:

a storage for temporarily receiving the card sent from the inlet through the passageway, and a collection device for storing the card through the passageway without transporting to the inlet, based on the information forwarded from the reading means, the control means controls the stowing operation of the card by and into the stacker or the discharging operation of the card by and from the stacker toward the inlet.

2. The card printing/stacking device of claim 1, wherein said transport means comprises an inlet sensor for detecting the card inserted into the inlet of the passageway to produce a detection signal to the control means, and a conveyor driven by the control means in response to the detection signal from the inlet sensor for transporting the card along the passageway.

3. The card printing/stacking device of claim 1, wherein the reading means is a photo-electric or magneto-electric sensor.

4. The card printing/stacking device of claim 1, wherein the printing means comprises:

a printer head disposed in the vicinity of the passageway for thermally printing information on a partly heated area of the card, a head driver for moving the printer head between the printing position adjacent to the passageway and the rest position away from the passageway, and an eraser head disposed in the vicinity of the passageway for thermally erasing information on a partly heated area of the card.

5. The card printing/stacking device of claim 1, wherein the transport means comprises a pair of inlet rollers arranged behind the inlet sensor on opposite sides of the passageway, an anterior sensor arranged in the vicinity of the passageway behind the inlet rollers for detecting passage of the card, a pair of intermediate rollers arranged behind the anterior sensor on opposite sides of the passageway, an intermediate sensor arranged behind the intermediate rollers in the vicinity of the passageway for detecting passage of the card, a pair of posterior rollers arranged behind the intermediate sensor on opposite sides of the passageway, and a posterior sensor arranged behind the posterior rollers on opposite sides of the passageway.

6. The card printing/stacking device of claim 1, wherein the stacker comprises a deflector arranged at an entrance of the stacker for movement of the deflector between the storage position for moving the card toward the storage to store the card therein and the collection position for moving the card toward the collection device to store the card therein, and drive means for moving the deflector between the storage and collection positions in accordance with drive signals from the control means.

7. The card printing/stacking device of claim 6, wherein the stacker further comprises a rotary guide arranged between the passageway and deflector.

8. The card printing/stacking device of claim 1, wherein said stacker comprises retainer means for supporting the cards for the stationary state in the collection device when the card is stowed into the storage or drawn from the storage and for supporting the cards for the stationary state in the storage when the card is stowed into the collection device.

9. The card printing/stacking device of claim 8, wherein the retainer means further comprises a holder in the stacker for movement of the holder between the lower position for urging the cards in the collection device for the stationary state and the upper position for urging the cards in the storage for the stationary state.

10. The card printing/stacking device of claim 9, wherein the retainer means comprises a retention motor disposed in the card printer, and a linkage for transmitting a torque from the retention motor to the holder to move the holder to the lower position for urging the cards in the collection device or to the upper position for urging the card in the storage by forward or adverse rotation of the retention motor.

11. The card printing/stacking device of claim 9, further comprising:

a stack motor disposed in the card printer, a stack roller disposed in the stacker selectively in contact to the card in the storage or in the collection device, and a power transmitter for transmitting torque from the stack motor to the stack roller, wherein, the stacker roller in contact to the card in the storage is operated to stow a card into the storage or to draw a card from the storage, the stacker roller in contact to the card in the collection device is operated to stow a card into the collection device.

12. The card printing/stacking device of claim 10, wherein the stacker is removably attached to the card printer for defining the passageway.

13. The card printing/stacking device of claim 1, wherein the control means is connected to an external control device for writing information on the card or for erasing information from the card when the control means receives writing or erasing instructions from the external control device.

* * * * *